US005190852A

United States Patent [19]

Matsuda et al.

[11] Patent Number: 5,190,852

[45] Date of Patent: Mar. 2, 1993

[54] SILVER HALIDE PHOTOGRAPHIC MATERIAL

[75] Inventors: Naoto Matsuda; Michio Ono, both of Kanagawa, Japan

[73] Assignee: Fuji Photo Film Co., Ltd., Kanagawa, Japan

[21] Appl. No.: 833,799

[22] Filed: Feb. 12, 1992

[30] Foreign Application Priority Data

Feb. 13, 1991 [JP] Japan ..... 3-40498

[51] Int. Cl.[5] ..... G03C 5/54; G03C 7/26; G03C 1/84

[52] U.S. Cl. ..... 430/517; 430/203; 430/218; 430/219; 430/223; 430/543; 430/544; 430/559; 430/564; 430/566; 430/955; 430/957; 430/958; 430/959

[58] Field of Search ..... 430/223, 543, 544, 955, 430/957, 203, 218, 219, 564, 566, 517, 959, 958

[56] References Cited

U.S. PATENT DOCUMENTS 4,783,396 11/1988 Nakamura et al. ..... 430/223
4,840,887 6/1989 Nakamura ..... 430/223
4,916,047 4/1990 Koya ..... 430/223

*Primary Examiner*—Richard L. Schilling
*Attorney, Agent, or Firm*—Sughrue, Mion, Zinn, Macpeak & Seas

[57] ABSTRACT

Disclosed is a silver halide photographic material comprising a support having thereon at least one layer containing a compound represented by general formula (I):

(I)

wherein EAG represents an electron-accepting group; A represents a group which undergoes a reaction triggered by the cleavage of the oxygen-nitrogen single bond in the general formula to release PUG; B represents a hydrogen atom or an alkyl group, an aralkyl group, an aryl group, a heterocylic group, an acyl group, a sulfonyl group, a carbamoyl group, a sulfamoyl group, an alkoxycarbonyl group, an aryloxycarbonyl group, an alkoxysulfonyl group or an aryloxysulfonyl group which may contain substituents; the solid lines indicate a single bond; the broken lines indicate that either of these line is a bond, with the proviso that when the broken line between N and A represents a bond, B is not present; EAG and B, and A and B may be connected to each other to form a ring; EAG may be connected to a polymer residue to fix the compound of general formula (I) to a high molecular chain; n represents an integer 0 or 1; and PUG represents a photographically useful group, with the proviso that when n is 0, PUG represents a photographically useful group represented by general formula (II);

(II)

wherein X and Y each represents an atom or atomic group required to render the group represented by general formula (II) photographically useful; the solid lines indicate a single bond; and the broken line indicate that either of these lines is a bond, with the provision that X and Y may be connected to each other to form a heterocyclic group containing N and when the broken line between N and X represents a bond, Y is not present.

12 Claims, No Drawings

SILVER HALIDE PHOTOGRAPHIC MATERIAL

FIELD OF THE INVENTION

The present invention relates to a silver halide photographic material. More particularly, the present invention relates to a silver halide photographic material comprising a novel compound which undergoes reduction to release a photographically useful group.

BACKGROUND OF THE INVENTION

An important technique for the construction of silver halide light-sensitive materials is one in which an inherently mobile photographically useful compound is combined with a compound provided with nondiffusibility to fix itself to specified portions on a support, and then undergoes a chemical reaction with reacting agents and reaction initiators which have been externally supplied upon processing to release a photographically useful compound. In particular, functional redox compounds which undergo a reaction triggered by an oxidation or reduction reaction upon processing to release a photographically useful compound can be expected to exert various effects which cannot be attained with other precursors. For example, the use of a functional redox compound which releases a dye can give a design in which an oxidation or reduction reaction takes place in correspondence to or counter correspondence to the exposure of silver halide to obtain color images. Among these functional redox compounds, compounds which undergo reduction to release a photographically useful compound are advantageous in that they are fairly stable and can easily provide positive images in counter correspondence to the exposure of silver halide and have thus been extensively studied.

Examples of functional redox compounds which undergo reduction to release a photographically useful compound include compounds which undergo an intramolecular nucleophilic reaction after reduction to release a photographically useful compound as disclosed in U.S. Pat. Nos. 4,139,379, 4,139,389, and 4,564,577, and JP-A-59-185333 and JP-A-57-84453 (the term "JP-A" as used herein means an "unexamined published Japanese patent application"), and compounds which undergo an intramolecular electron transfer reaction after reduction to release a photographically useful compound as disclosed in U.S. Pat. No. 4,232,107, JP-A-59-101649, and JP-A-61-88257, and Research Disclosure (1984) IV No. 24025.

Examples of compounds which utilize cleavage of specific bonds by reduction include compounds which utilize reduction cleavage of a nitrogen-sulfur bond as disclosed in German Patent 3,008,588, and JP-A-62-244048, compounds which utilize a nitrogen-nitrogen bond as disclosed in U.S. Patent 4,619,884, α-nitro compounds which undergo cleavage of a carbon-hetero atom single bond after receiving electrons as disclosed in German Patent 3,207,583, and dieminal dinitro compounds which undergo β-elimination of a photographically useful group after reduction cleavage of a nitrogen-nitrogen (nitro group) bond as disclosed in U.S. Pat. No. 4,609,610. Examples of compounds which utilize reduction cleavage of a carbon-hetero atom single bond include newly developed compounds as disclosed in JP-A-62-215270 and European Patent 220746A2.

Further, in recent years, as positive-working redox compounds which can attain both excellent stability and processing activity, compounds have been developed as disclosed in JP-A-62-215270 and European Patent 220746A2.

The foregoing functional redox compounds which undergo reduction to release a photographically useful group have their advantages. However, it is desirable to provide a new means of releasing a photographically useful group in order to enhance its functions corresponding to the purpose or enhance the degree of freedom of design in the preparation of photographic light-sensitive materials.

SUMMARY OF THE INVENTION

It is therefore an object of the present invention to provide a silver halide photographic material comprising a truly novel compound which undergoes reaction with a reducing substance (a reducing agent) commonly used in the art to release a photographically useful group at an extremely high rate.

The above and other objects of the present invention will become more apparent from the following detailed description and examples.

The inventors have studied the cleavage reaction of a nitrogen-oxygen single bond on the basis of the technique as disclosed in JP-A-62-215270. As a result, it was found that a nitrogen-oxygen single bond connected to an electron-accepting group on its oxygen side undergoes an extremely rapid cleavage after receiving electrons. It was also found that this reaction proceeds at a sufficiently high rate even under neutral conditions. The object of the present invention is accomplished by the use of a silver halide photographic material which comprises a compound containing a nitrogen-oxygen single bond represented by general formula (I):

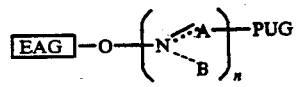

(I)

wherein EAG represents an electron-accepting group; A represents a group which undergoes a reaction triggered by the cleavage of the oxygen-nitrogen single bond in general formula to release PUG; B represents a hydrogen atom or an alkyl group, an aralkyl group, an aryl group, a heterocylic group, an acyl group, a sulfonyl group, a carbamoyl group, a sulfamoyl group, an alkoxycarbonyl group, an aryloxycarbonyl group, an alkoxysulfonyl group or an aryloxysulfonyl group which may contain substituents; the solid line indicates a single bond; the broken line indicates that either of these lines is a bond, with the proviso that when the broken line between N and A represents a bond, B is not present; EAG and B, and A and B may be connected to each other to form a ring; EAG may be connected to a polymer residue to fix the compound of general formula (I) to a high molecular chain; n represents an integer 0 or 1; and PUG represents a photographically useful group, with the proviso that when n is 0, PUG represents a photographically useful group represented by general formula (II):

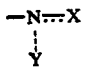

(II)

wherein X and Y each represents an atom or atomic group required to render the group represented by general formula (II) photographically useful; the solid lines indicate a single bond; and the broken lines indicate that either of these lines is a bond, with the proviso that X and Y may be connected to each other to form a heterocyclic group containing N and when the broken line between N and X represents a bond, Y is not present.

The mechanism by which the compound represented by general formula (I) undergoes a reaction with a reducing substance to release a photographically useful group is not yet known in detail. However, the inventors believe that the compounds of the present invention can be roughly divided into two groups: (a) those having a structure such that the electron-accepting portion (EAG) which receives two electrons from a reducing substance and (b) those having a structure such that the EAG receives one electron from the reducing substance.

In the structure (a), as a result of the reception of two electrons, the electron-accepting portion is reduced. Then, a rapid intramolecular electron transfer takes place so that an electron moves to the nitrogen atom in the nitrogen-oxygen bond cleaved from the electron-accepting portion in the reduced form. As a result, the compounds of general formula (I) wherein n is 0 release a photographically useful group represented by general formula (II), and the compounds of general formula (I) wherein n is 1 undergo a subsequent reaction to release a photographically useful group.

In the structure (b), the electron-accepting portion receives one electron to become an anion radical while the reducing substance becomes a one-electron oxidant. This reaction is believed to achieve equillibrium. However, the cleavage of the nitrogen-oxygen bond from the anion radical intermediate takes place irreversibly to release a photographically useful group.

The compound represented by general formula (I) will be further described hereinafter. EAG will be described first.

EAG represents a group which receives electrons from a reducing substance and is connected to an oxygen atom. Preferred examples of groups as EAG include quinones (e.g., quinones which may be substituted, such as 1,4-benzoquinone-2-il, 1,4-naphthoquinone-2-il, 3,5,6-trimethyl-1,4-benzoquinone-2-il, 5-benzoylamino-1,4-benzoquinone-2-il, 5-t-octyl-1,4-benzoquinone-2-il, 3-carbamoyl-6-pentadecyl-1,4-benzoquinone-2-il, 1,2-benzoquinone-4-il, 1,2-naphthoquinone-4-il, -hexadecyloxy-1,2-benzoquinone-4-il), aryl groups substituted by at least one electrophilic group (e.g., 4nitrophenyl, 2-nitrophenyl, 2-nitro-4-N-methyl-Noctadecylsulfamoylphenyl, 2-N,N-dimethylsulfamoyl-4nitrophenyl, 2-cyano-4-octadecylsulfonylphenyl, -nitro-4-N-methyl-N-hexadecylcarbamoylphenyl, 2,4-dimethanesulfonyl, 2,4-dinitrophenyl, 2,4,6-tricyanophenyl, 2,4-dinitronaphthyl, 2,3,4,5,6-pentafluorophenyl, 2-nitro-4-trifluoromethyl phenyl, 2-chloro-4-nitro-5-methylphenyl), substituted or unsubstituted heterocyclic groups (e.g., 2-pyridyl, 2-pyradyl, 5-nitro-2-pyridyl, 5-N-hexadecylcarbomoyl-2-pyridyl, 5-dodecylsulfonyl-2-pyridyl, 5-cyano-2-pyradyl, 4-nitrothiophene-2-il, 5-nitro-1,2-dimethylimidazole-4-il, 3,5-diacetyl-2-pyridyl, 1-methylpyridinium-2-il, 1-benzyl-5-carbamoylpyridinium-2-il, 1-methylpyridinium-4-il, 1-dodecylpyridinium-4-il, 1-methyl-3-carboethoxy-5-N-octadecylcarbamoylpyridinium-2-il), quinone analogues having by the following structures (* indicates the portion to be connected to an oxygen atom):

1.

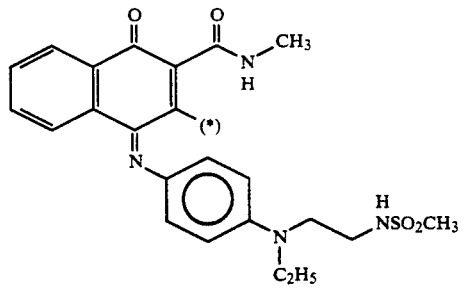

2.

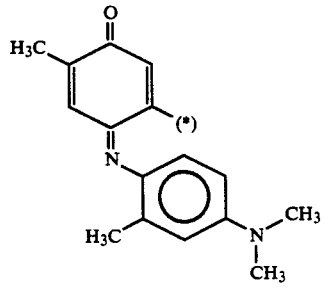

3.

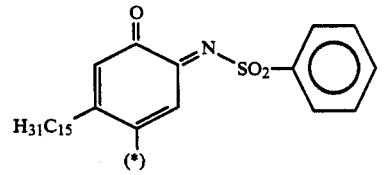

4.

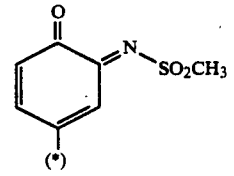

5.

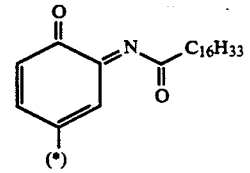

6.

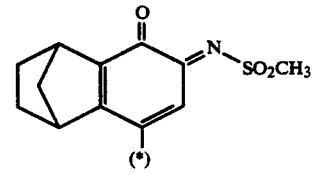

7.

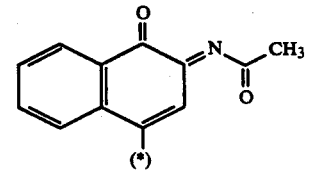

and vinylogs thereof. The term "vinylog" as used herein means that the above-exemplified groups as EAG may be bound to the oxygen atom in general formula (I) through a unsaturated bond such as a double bond or a triple bond.

EAG may be connected to a polymer residue, however, it is preferred that the EAG is not connected to a polymer residue.

The term "a polymer residue" means a group present on the terminal of a polymer. That is, EAG may be connected to a polymer through the polymer residue. Examples of the polymer residue to which the EAG may be connected include an alkyl group, an aralkyl group, an aryl group, an alkenyl group, an alkynyl group, an acyl group, a sulfonyl group, a heterocyclic group, an amino group, an alkoxy group, an aryloxy group, an alkylthio group, an arylthio group, an acyloxy group, a sulfonyloxy group, an acylamino group or a sulfonylamino group. Examples of the polymer include acrylic esters, metacrylic esters and acrylic amides.

The group represented by A undergoes a reaction triggered by the cleavage of the oxygen-nitrogen bond caused by the reception of electrons by EAG to release a photographically useful group. Preferred examples of the group represented by A include those represented by general formulae (A-1) to (A-7) wherein (*)(*) indicates the position at which the compound is connected to a nitrogen atom; and (*)(*)(*) indicates the position at which the compound is connected to PUG:

(A-1)

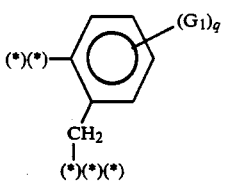

wherein $G_1$ represents a hydrogen atom, an alkyl group, an aralkyl group, an aryl group, a heterocyclic group, $—OR^1$, $—SR^1$, $—O_2C—R^1$, $—O_3S—R^1$, $—NR^2R^2$, $—NR^2OC-R^1$, $—NR^2O_2S—R^1$, $—CO_2R^1$, $—CONR^1R^2$, $—SO_2NR^1R^2$, $—COR^1$, $—SO_2R^1$, a halogen atom, a cyano group, or a nitro group; $R^1$ and $R^2$ may be the same or different and each represents a hydrogen atom, an alkyl group, an aralkyl group, an aryl group or a heterocyclic group; and q represents an integer from 1 to 4, with the proviso that when q is 2 or more, the substituents represented by $G_1$ may be the same or different or the $G_1$ groups may be connected to each other to form a ring;

(A-2)

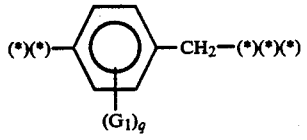

wherein $G_1$ and q are as defined in general formula (A-1);

(A-3)

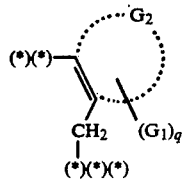

wherein $G_2$ represents an atomic group required to form a 5- to 7-membered heterocyclic group comprising at least one atom selected from the group consisting of carbon, nitrogen, oxygen and sulfur, the heterocyclic group optionally being condensed with benzene ring, another heterocyclic group, etc. (preferred examples of such a heterocyclic group include pyrrole, pyrazole, imidazole, triazole, furan, oxazole, thiophene, thiazole, pyridine, pyridazine, pyrimidine, pyrazine, azepine, oxepine, indole, and benzofuranquinoline); and $G_1$ and q are as defined in general formula (A-1);

(A-4)

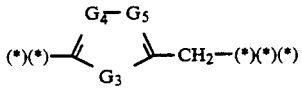

wherein $G_3$ represents an atomic group required to form a 5- to 7-membered heterocyclic group comprising at least one compound selected from the group consisting of carbon, nitrogen, oxygen and sulfur; and $G_4$ and $G_5$ each represents $—C(R_3)=$ or $—N=$ in which $R_3$ represents a hydrogen atom, an alkyl group or an aryl group, the heterocyclic group optionally being condensed with benzene ring or 5- to 7- membered heterocyclic group (preferred examples of such a heterocyclic group include pyrrole, imidazole, triazole, furan, oxazole, oxadiazole, thiophene, thiazole, thiadiazole, pyridine, pyridazine, pyrimidine, pyrazine, azepine, oxepine, and isoquinoline);

(A-5)

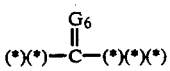

wherein $G_6$ represents an oxygen atom or a sulfur atom;

(A-6)

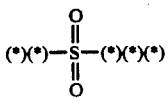

(A-7)

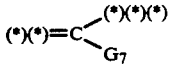

wherein $G_7$ represents a hydrogen atom or an alkyl, aralkyl, aryl, alkoxy, alkylthio, aryloxy, arylthio, amino, carbonylamino or heterocyclic group which may be substituted.

The group represented by B is connected to a nitrogen atom and represents a group selected to adjust the reactivity and stability of the compound represented by general formula (I). Preferred examples of the group represented by B include a hydrogen atom, an alkyl group, an aralkyl group (e.g., the alkyl group which may be substituted, such as methyl, trifluoromethyl, benzyl, chloromethyl, dimethylaminomethyl, ethoxycarbonylmethyl, aminomethyl, acetylaminomethyl, ethyl, carboxyethyl, allyl, 3,3,3-trichloropropyl, n-propyl, iso-propyl, n-benzyl, iso-butyl, sec-butyl, t-butyl, n-benzyl, sec-pentyl, t-pentyl, cyclopentyl, n-hexyl, sec-hexyl, t-hexyl, cyclohexyl, n- octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, and t-octadecyl), an alkenyl group (e.g., alkenyl group which may be substituted, such as vinyl, 2-chlorovinyl, 1-methylvinyl, 2-cyanovinyl, and cyclohexene-1-il}, an alkynyl group (e.g., alkynyl group which may be substituted, such as ethynyl, 1-propynyl, and 2-ethoxycarbonyl ethynyl), an aryl group (e.g., aryl group which may be substituted, such as phenyl, naphthyl, 3-hydroxyphenyl, 3-chlorophenyl, 4-acetylaminophenyl, 2-methanesulfonyl-4-nitrophenyl, 3-nitrophenyl, 4-methoxyphenyl, 4-acetylaminophenyl, 4-methanesulfonylphenyl, and 2,4-dimethylphenyl), a heterocyclic group (e.g., heterocyclic group which may be substituted, such as 1-imidazolyl, 2-furyl, 2-pyridy1,5-nitro-2-pyridy1,3-pyridy1,3,5-dicyano-2-pyridyl, 5-tetrazolyl, 5-phenyl-1-tetrazolyl, 2-benzthiazolyl, 2-benzimidazlyl, 2-benzoxazolyl, 2-oxazoline-2-il, and morpholino), an acyl group (e.g., acyl group which may be substituted, such as acetyl, propionyl, butyloyl, iso-butyloyl, 2,2-dimethylpropionyl, benzoyl, 3,4-dichlorobenzoyl, 3-acetylamino-4-methoxybenzoyl, 4-methylbenzoyl, and 4-methoxy-3-sulfobenzoyl), a sulfonyl group (e.g., sulfonyl group which may be substituted, such as methanesulfonyl, ethanesulfonyl, chloromethanesulfonyl, propanesulfonyl, butanesulfonyl, benzenesulfonyl, and 4-toluenesulfonyl), a carbamoyl group (e.g., carbamoyl group which may be substituted, such as carbamoyl, methylcarbamoyl, dimethylcarbamoyl, bis-(2-methoxyethyl)carbamoyl, and diethylcarbamoyl, cyclohexylcarbamoyl), a sulfamoyl group (e.g., sulfamoyl group which may be substituted, such as sulfamoyl, methylsulfamoyl, dimethylsulfamoyl, diethylsulfamoyl, bis-(2-methoxy)sulfamoyl, di-n-butylsulfamoyl, 3-ethoxypropylmethylsulfamoyl, and N-phenyl-N-methylsuylfamoyl), an alkoxy or aryloxycarbonyl group (e.g., alkoxy or aryloxycarbonyl group which may be substituted, such as methoxycarbonyl, ethoxycarbonyl, phenoxycarbonyl, and 2-methoxyethoxycarbonyl), and an alkoxy or an aryloxysulfonyl group (e.g., alkoxy or aryloxysulfonyl group which may be substituted, such as methoxysulfonyl, ethoxysulfonyl, phenoxysulfonyl, and 2-methoxyethoxysulfonyl).

PUG represents a photographically useful group.

Examples of such a photographically useful group include a development inhibitor, a development accelerator, a nucleating agent, a coupler, a diffusive or nondiffusive dye, a desilvering accelerator, a desilvering inhibitor, a silver halide solvent, a competitive compound, a developing agent, an auxiliary developing agent, a fixation accelerator, a fixation inhibitor, an image stabilizer, a toner, a processing dependence improver, a halftone improver, a dye image stabilizer, a photographic dye, a surface active agent, a film hardener, a desensitizer, a contrast developer, a chelating agent, a fluorescent brightening agent, a filter dye (a dye for a filter) and precursors thereof.

Many of these photographically useful groups overlap each other with respect to their utility. Typical examples of these photographically useful groups will be further described hereinafter.

Examples of development inhibitors include compounds containing a mercapto group connected to a heterocyclic group such as substituted or unsubstituted mercaptoazoles (e.g., 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2carboxyethylthio)-5-mercapto-1,3,4-thiadiazole, 3-methyl-4-phenyl-5-mercapto-1,2,4-triazole, 2-(2-dimethylaminoethylthio) 3-methyl-4phenyl-5-mercapto-1,2,4-thriazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-{3-(3-methylureide)phenyl}-5mercaptotetrazole, 1-(4-nitrophenyl)-5-mercaptotetrazole, 5-(2-ethylhexanoylamino)-2-mercaptobenzimidazole), substituted or unsubstituted mercaptoazaindenes (e.g., 6-methyl-4-mercapto-1,3,3*a*,7-tetrazaindene, 6-methyl-2-benzyl-4-mercapto-1,3,3*a*,7-tetrazaindene, 6-phenyl-4-mercaptotetrazaindene, 4,6-dimethyl-2-mercapto-1,3,3*a*,7tetrazaindene), substituted or unsubstituted mercaptopyrimidines (e.g., 2-mercaptopyrimidine, 2-mercapto-4-methyl-6-hydroxypyrimidine, 2-mercapto-4propylpyrimidine), heterocyclic compounds capable of forming imino silver compounds such as substituted or unsubstituted benzotriazoles (e.g., benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, 4,5,6,7-tetrachlorobenzotriazole), substituted or unsubstituted indazoles (e.g., indazole, 5-nitroindazole, 3-nitroindazole, 3-chloro-5-nitroindazole, 3- cyanoindazole, 3-n-butylcarbamoylindazole, 5-nitro-3-methanesulfonylindazole), substituted or unsubstituted benzimidazoles (e.g., 5-nitrobenzimidazole, 4-nitrobenzimidazole, 5,6-dichlorobenzmidazole, 5-cyano-6-chlorobenzimidazole, 5-trifluoromethyl-6-chlorobenzimidazole). The development inhibitor may be released from the redox nucleus of general formula (I) by a reaction following the redox reaction in the development step to become a development-inhibiting compound which may then turn into a compound having substantially no or remarkably reduced development inhibiting effect.

Specific examples of such a development inhibitor include 1-(3-phenoxycarbonylphenyl)-5-mercaptotetrazole, 1-(4-phenoxycarbonylphenyl)-5-mercaptotetrazole, 1-(3-maleinimidephenyl)5-mercaptotetrazole , 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5- (2, 3dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylethoxycarbonyl)-2-mercaptobenzothiazole, 1-{4-(2-chloroethoxycarbonyl)phenyl}-2-mercaptoimidazole, 2-(3-{thiophene-2-ilcarbonyl}propyl)thio-5-mercapto-1,3,4-thiadiazole, 5-cinnamoylaminobenzotriazole, 1-(3-vinylcarbonylphenyl)-5-mercaptotetrazole, 5-succinimidemethylbenzotriazole, 2-{4-succinimidephenyl}-5-mercapto-1,3,4-oxadiazole, 3-{4-(benzo-1,2-isothiazole-3-oxo-1,1-dioxy-2-il)phenyl}-5-mercapto-4-methyl-1,2,4-triazole, and 6-phenoxycarbonyl-2-mercaptobenzoxazole.

Examples of diffusive or nondiffusive dye, PUG include azo dyes, azomethine dyes, azopyrazolone dyes, indoaniline dyes, indophenol dyes, anthraquinone dyes, triarylmethane dyes, alizarin, nitro dyes, quinoline dyes, indigo dyes, and phthalocyanine dyes. Other examples of such dyes include leuco compounds of the above mentioned dyes, dyes whose absorption wavelengths have been temporarily shifted, and dye precursors such as tetrazolium salt. These dyes may form chelate dyes with proper metals. These dyes are further described in U.S. Pat. Nos. 3,880,658, 3,931,144, 3,932,380, 3,932,381, and 3,942,987.

Among these dyes, cyan, magenta and yellow dyes are important because they form color images.

Examples of yellow dyes include those described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930 and 56-71072, and Research Disclosure 17630 (1978) and 16475 (1977). Examples of magenta dyes include those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and JP-A-52-106727, 53-23628, 55-36804, 56-73057, 56-71060, and 55-134. Examples of cyan dyes include those described in U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, 52-8827, 53-47823, 53-143323, 54-99431, and 56-71061, European Patents (EPC) 53,037, and 53,040, and Research Disclosure 17,630 (1978) and 16,475 (1977).

One of the dye precursors can be a dye whose light absorption has been temporarily shifted in a light-sensitive element. Specific examples of such a dye are described in U.S. Pat. Nos. 4,310,612, T-999,003, 3,336,287, 3,579,334, and 3,982,946, British Patent 1,467,317, and JP-A-158638.

Examples of silver halide solvents represented by PUG include mesoionic compounds as disclosed in JP-A-60-163042, and U.S. Pat. Nos. 4,003,910, and 4,378,424, and mercaptoazoles or azolethiones containing an amino group as a substituent as disclosed in JP-A-57-202531. Specific examples of such silver halide solvents are described in JP-A-61-230135.

Examples of the nucleating agents represented by PUG include an eliminatable group portion to be released from couplers as described in JP-A-59-170840.

For PUG, reference can also be made to JP-A-61-230135, and 62-215272, and U.S. Pat. No. 4,248,962.

The compound represented by general formula (I) is preferably one represented by general formula (III):

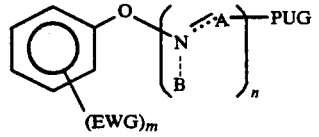

(III)

wherein EWG represents an electron-withdrawing group; m represents an integer from 1 to 5, and if m is 2 or more, the plurality of EWG groups may be the same or different; the phenyl group may contain from 0 to (5−m) substituents or be condensed with other aromatic rings, heterocyclic groups and nonaromatic rings and may be connected to B to form a ring or may be connected to a polymer residue to fix the compound of general formula (III) to a high molecular chain; A and B may be connected to each other to form a ring; and A, B, PUG, and n, the solid line, and the broken lines are as defined in formula (I), with the proviso that at least one of the plurality of the EWG groups is connected to the 2- or 4-position in the ring with respect to the oxygen atom.

Examples of EWG include a nitro group, a cyano group, a sufonyl group, a sulfamoyl group, a carbamoyl group, a carbonyl group, a halogen atom, and a trifluoromethyl group.

Furthermore, the compound represented by general formula (I) is preferably one represented by general formula (IV) or (V):

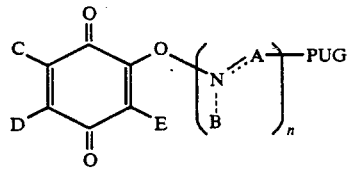

(IV)

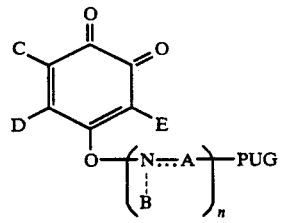

(V)

wherein C, D, and E each represents a hydrogen atom, a halogen atom, a cyano group, a nitro group, an alkyl group, an aralkyl group, an aryl group, an alkenyl group, an alkynyl group, an acyl group, a sulfonyl group, a heterocyclic group, an amino group, an alkoxy group, an aryloxy group, an alkylthio group, an arylthio group, an acyloxy group, a sulfonyloxy group, an acylamino group or a sulfonylamino group which may be substituted or a polymer residue thereof or a group represented by general formula (VI) and may be the same or different and may be connected to each other to form a ring:

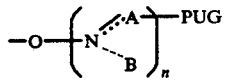

(VI)

; A and B, and B and E may be connected to each other to form a ring; and PUG, A, B, n, the solid line, and the broken line are as defined in general formula (I).

The term "a polymer residue thereof" as used herein means that the groups defined as C, D and E may be present on the terminal of a polymer. Examples of the polymer include acrylic esters, metacrylic esters and acrylic amides.

Specific examples of the compound of general formula (I) are set forth below, but the present invention should not be construed as being limited thereto:

Exemplary Compounds of General formula (I)

1.
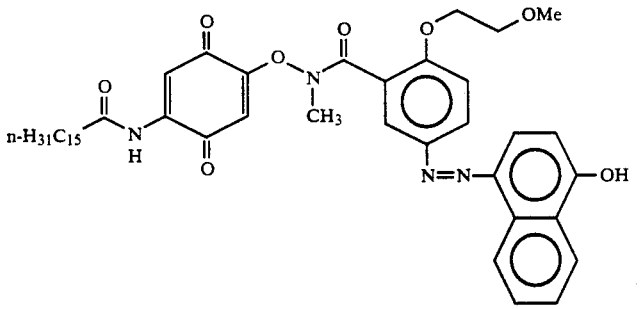
2.
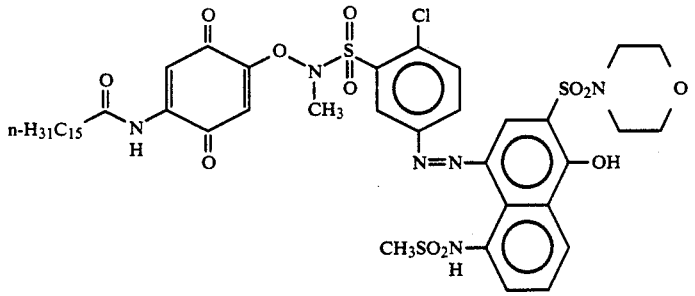
3.
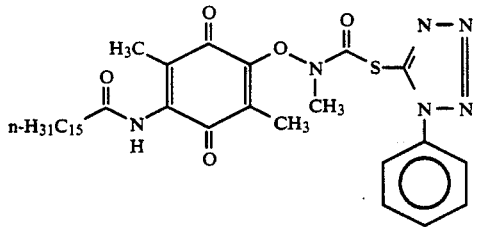
4.
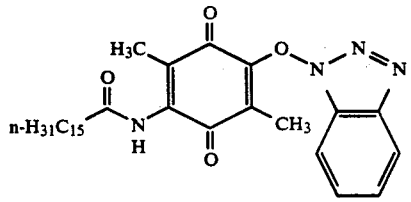
5.
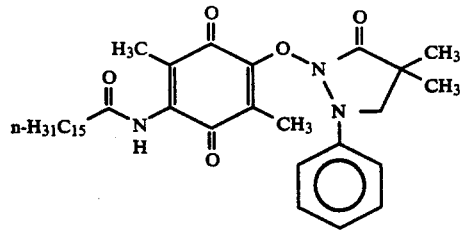
6.
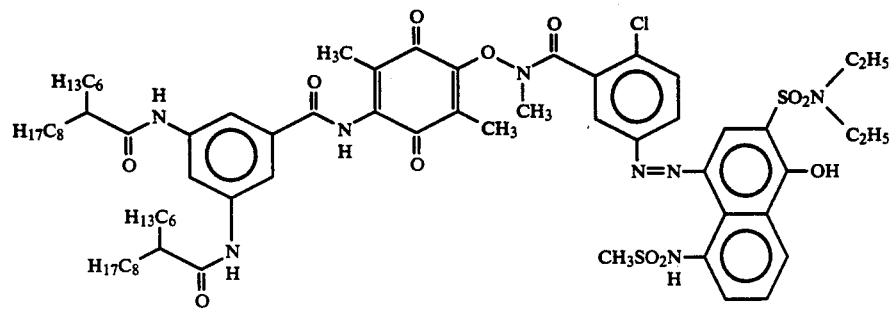

-continued
7.
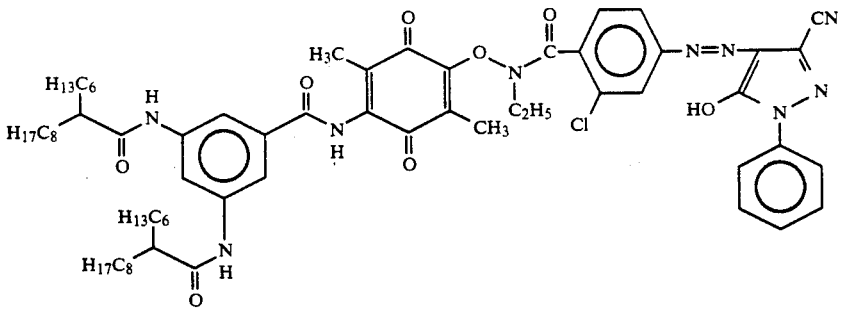
8.
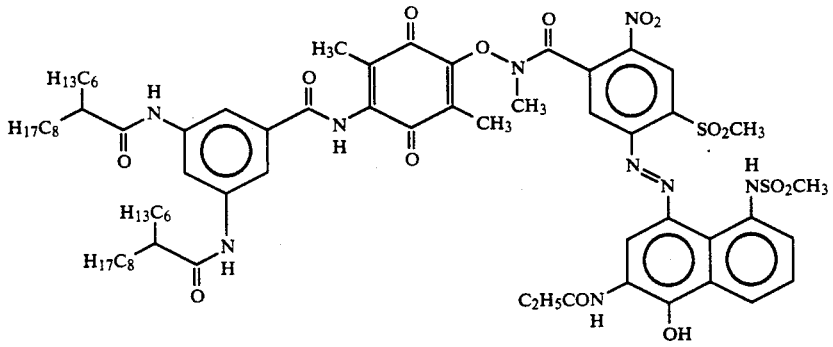
9.
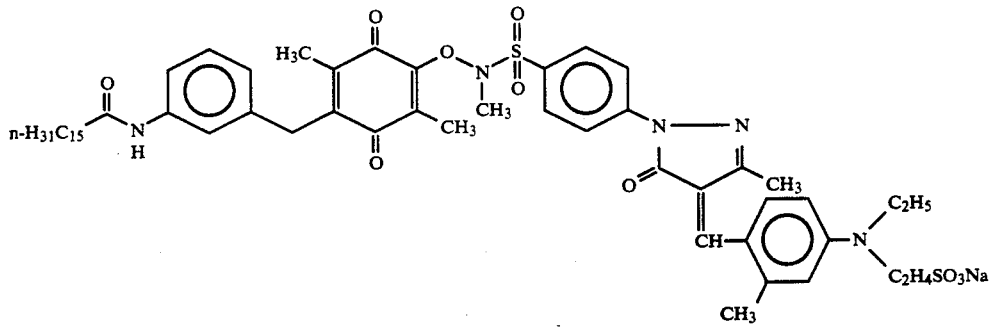
10.
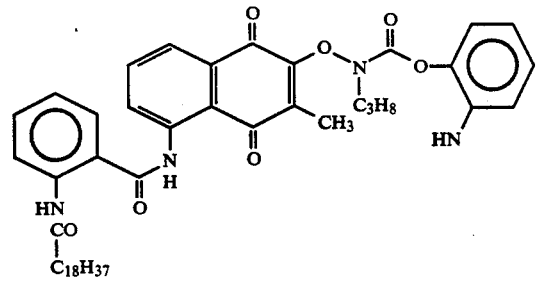
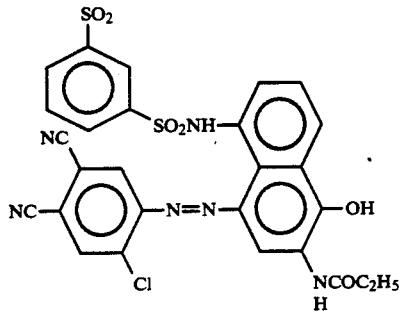

-continued
11.
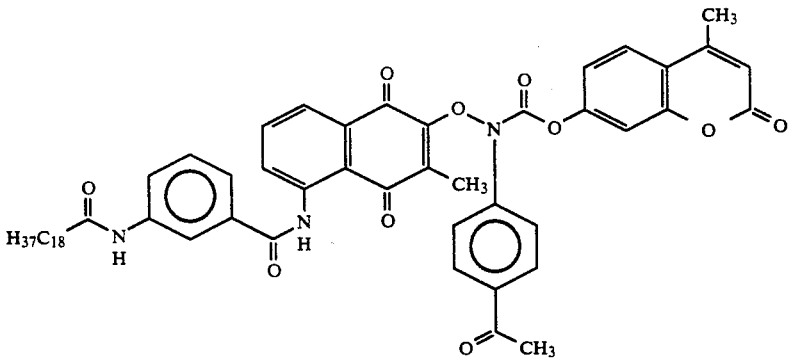
12.
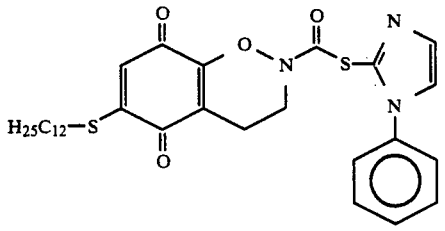
13.
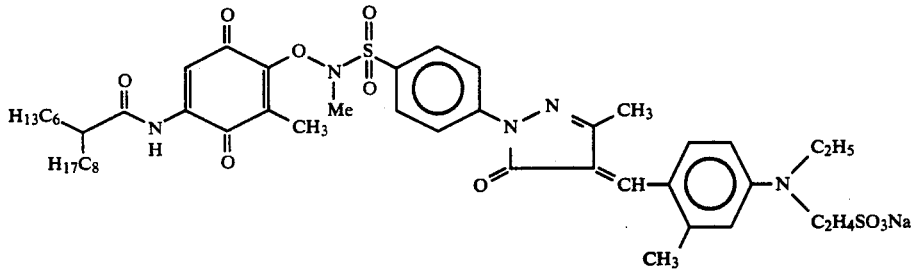
14.
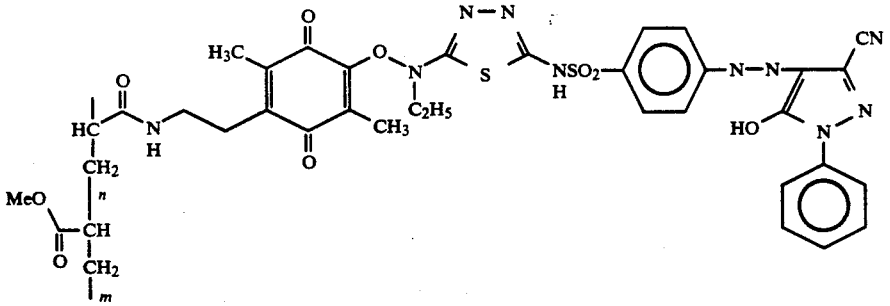
15.
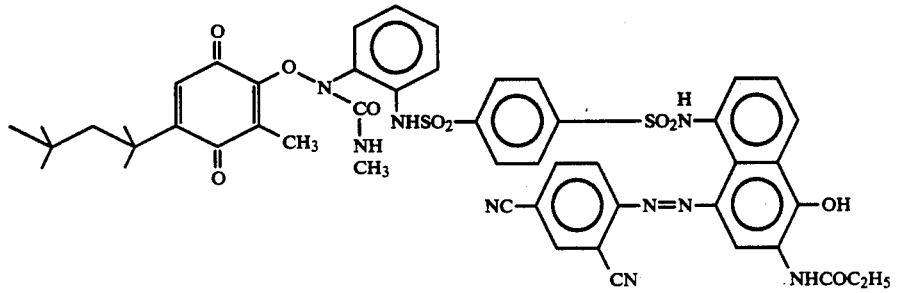

-continued
16.
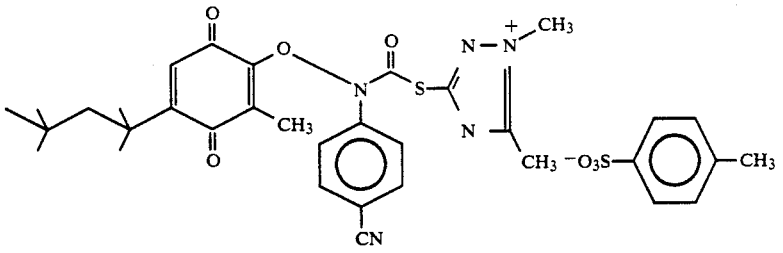
17.
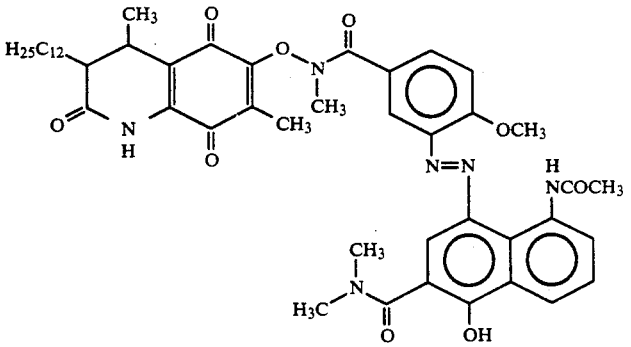
18.
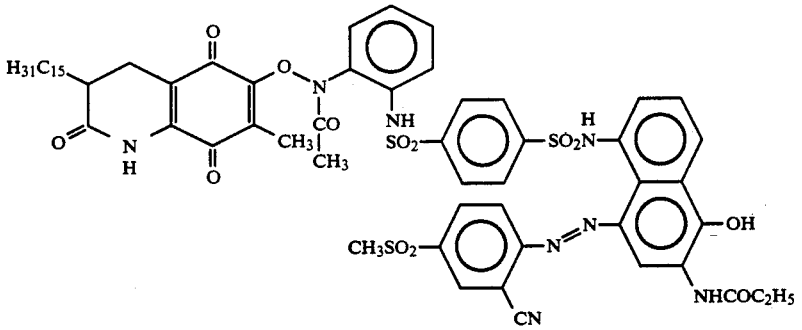
19.
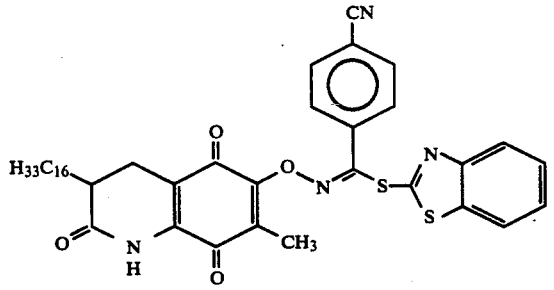
20.
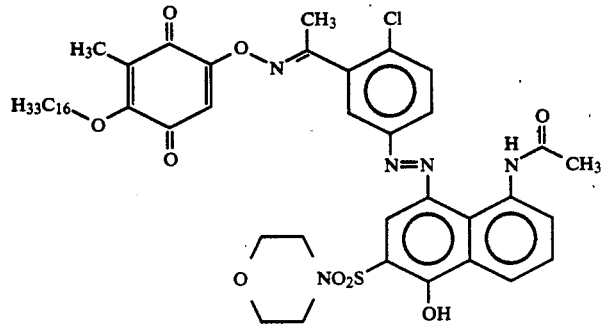

-continued
21.
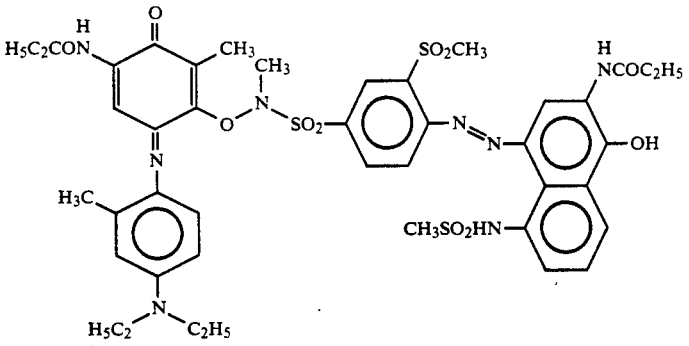
22.
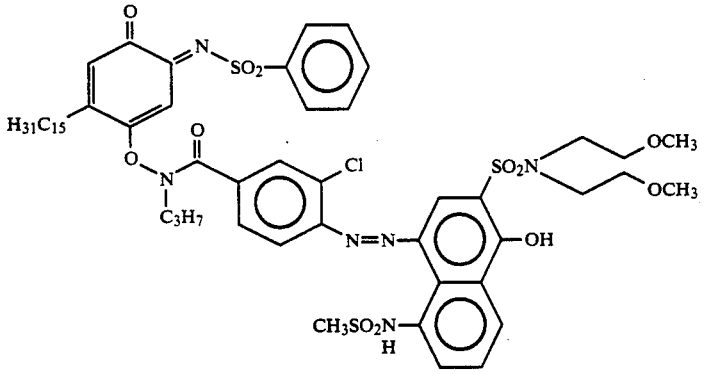
23.
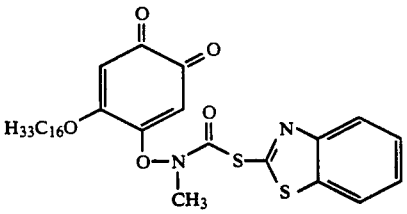
24.
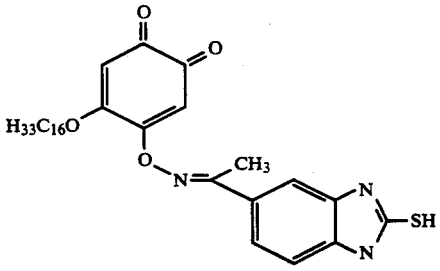
25.
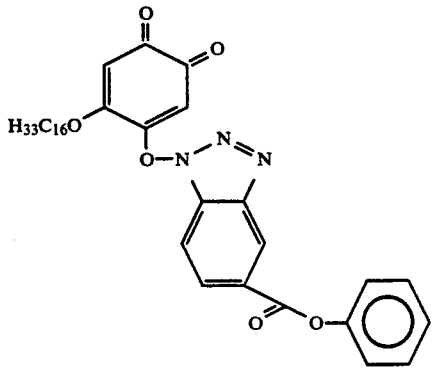

-continued
26.
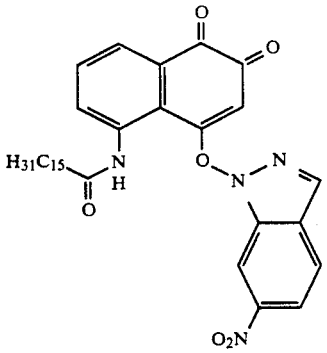
27.
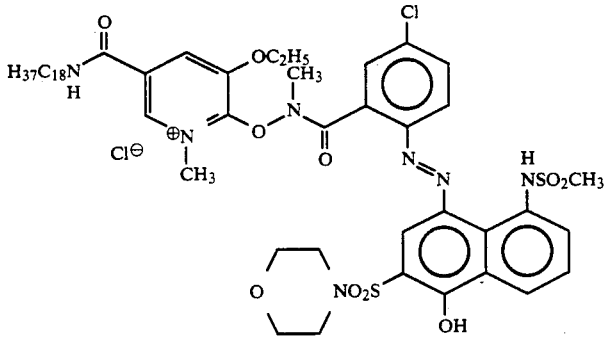
28.
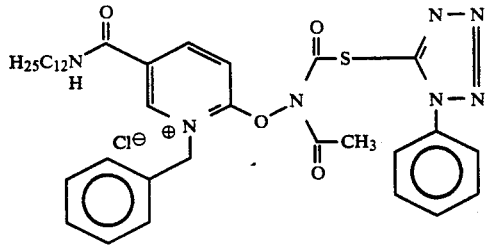
29.
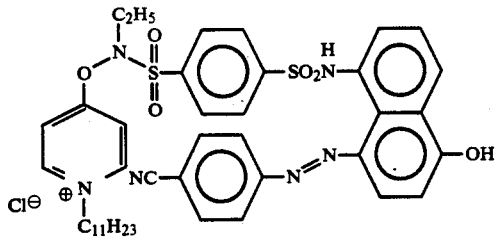
30.
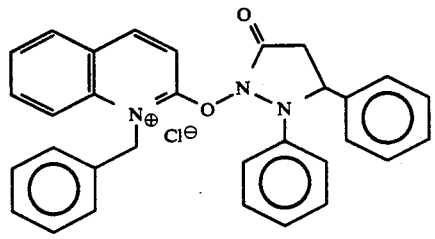

-continued
31.
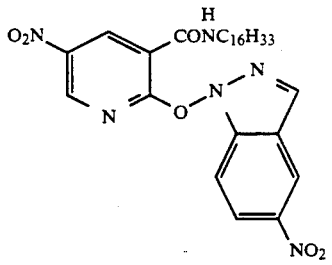
32.
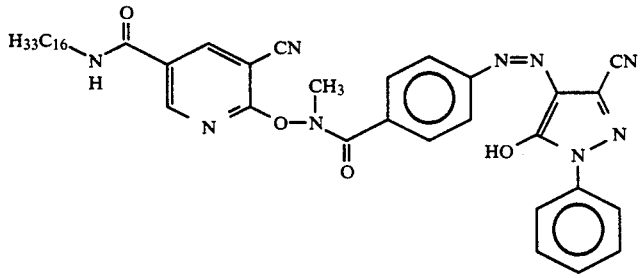
33.
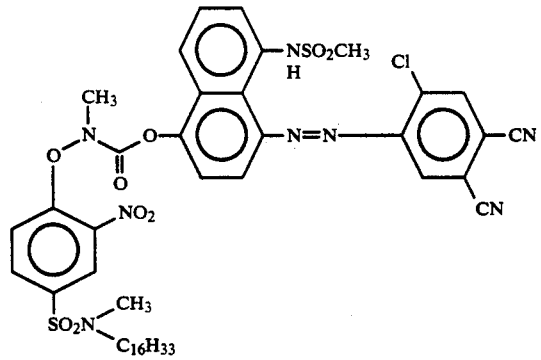
34.
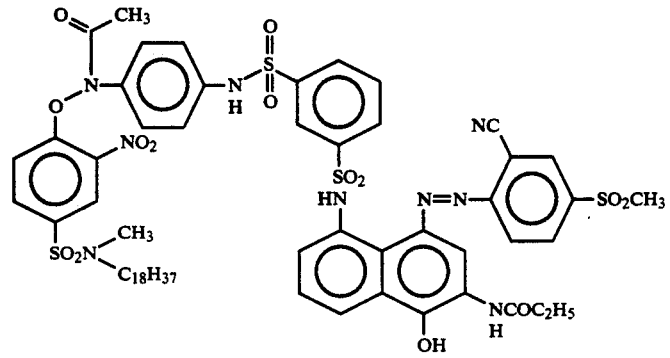

-continued
35.
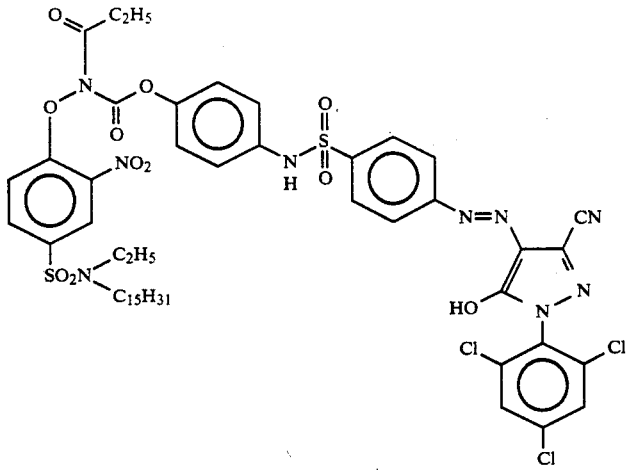
36.
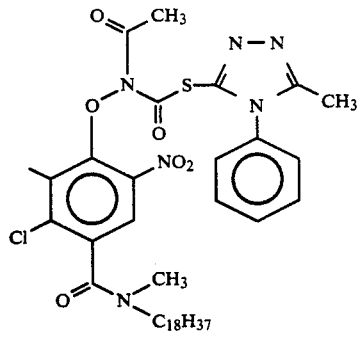
37.
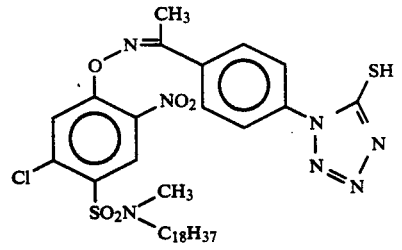
38.
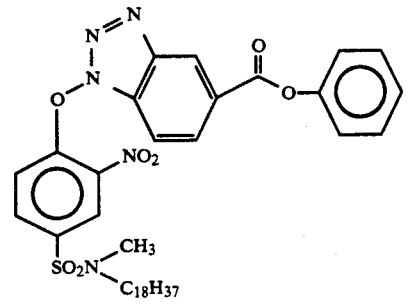

-continued

39.

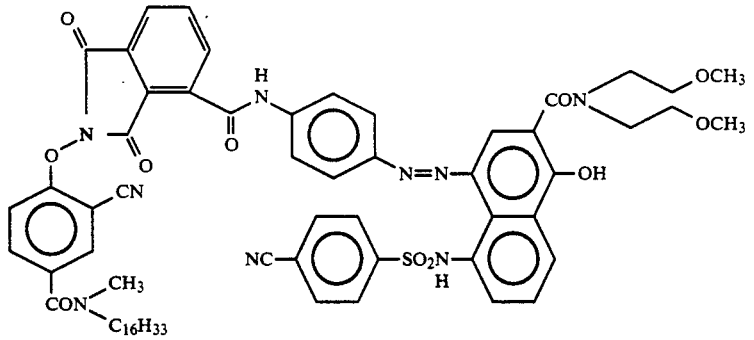

40.

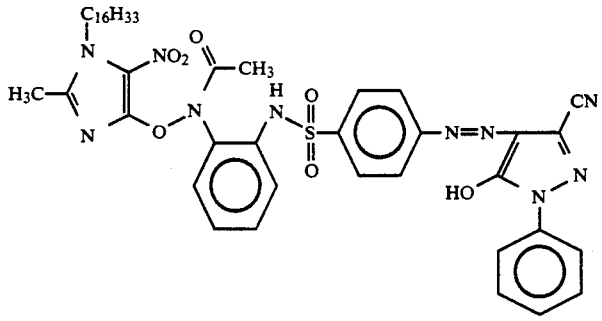

41.

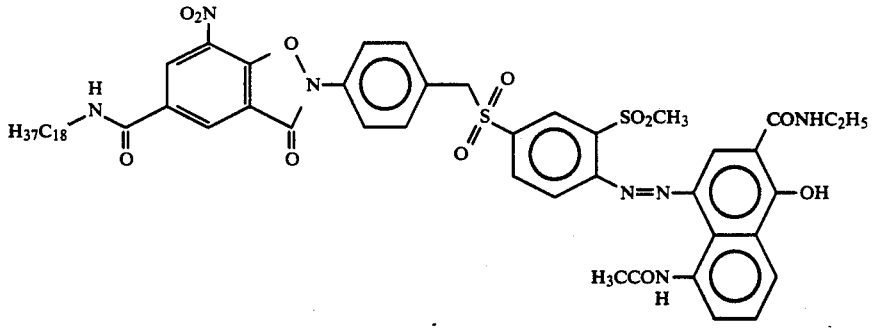

The synthesis of the compound of general formula (I) can be roughly divided into two methods. In one of the two synthesis methods, an electron-accepting portion substituted by an eliminatable group such as a halogen atom is reacted with a photographically useful group portion which has been synthesized in which a manner that is has a nitrogen-oxygen bond at its terminal to effect a nucleophilic substitution reaction with the eliminatable group. In the other method, an electron-accepting portion to which a hydroxylamine portion has been previously bonded is then reacted with an acid halide and acid anhydride in a photographically useful group. One of the two synthesis methods should be selected depending on the structure of the compound of the present invention to be synthesized.

Examples of synthesis of typical compounds of general formula (I) are set forth below:

SYNTHESIS OF EXEMPLARY COMPOUND 1

1-(1): Synthesis of 2-palmitoylamino-1,4-benzoquinone

To 100 g of 2,5-dimethoxyaniline were added 1,200 ml of acetonitrile and 63 ml of pyridine with stirring. 180 g of palmitoyl chloride was added dropwise to the system while the temperature thereof was kept at 20° to 30° C. After completion of the dropwise addition, the system was heated to a temperature of 60° C. to obtain a uniform solution which was then allowed to cool. The resulting crystal was filtered off, washed with water, and then dried to obtain 240 g of 2-palmitoylamino-1,4-dimethoxygenzene in crystal form. To 240 g of the crystal thus obtained were added 1,000 ml of toluene and 250 g of anhydrous aluminum chloride. The system was then heated to a temperature of 90° C. at which temperature it was allowed to undergo reaction for 40 minutes. After completion of the reaction, the reaction system was poured into 1,200 ml of ice water. The reaction system was then extracted with 1,500 ml of ethyl acetate. The extract was then washed with saturated brine. 100 ml of concentrated nitric acid was then gradually added to the system with stirring at room temperature for 30 minutes. The reaction solution was washed with 1,000 ml of water with saturated aqueous solution of sodium hydrogencarbonate and then with saturated brine, and then concentrated by means of a rotary evaporator. The concentrate was dissolved in 200 ml of ethyl acetate at an elevated temperature. 1,200 ml of acetonitrile was then added to the system which was then cooled for crystallization. The resulting crystal was filtered off and then dried to obtain 160 g of 2-palmitoylamino-1,4-benzoquinone in crystal form. (Yield: 78%)

1-(2): Synthesis of 2-palmitoylamino-5-chloro-1,4-benzoquinone

To 100 g of 2-palmitoylamino-1,4-benzoquinone were added 500 ml of ethyl acetate was stirring. The system was then allowed to undergo reaction at room temperature with hydrogen chloride gas blown thereinto for 2 hours. After completion of the reaction, the reaction system was washed with 1,000 ml of iced water. 50 ml of concentrated nitric acid was then added to the system which was then allowed to undergo reaction at room temperature for 30 minutes. After completion of the reaction, the reaction system was washed with 500 ml of water and then with a saturated aqueous solution of sodium hydrogencarbonate and saturated brine. To the resulting ethyl acetate solution was added 1,500 ml of acetonitrile. The reaction system was then cooled for crystallization. The resulting crystal was filtered off, and then dried to obtain 70 g of 2-palmitoylamino-5-chloro-1,4-benzoquinone. (Yield: 64%)

1-(3): Synthesis of Exemplary Compound 1

To 50 g of 2-palmitoylamino-5-chloro-1,4- benzoquinone and 23 g of Dye A (shown below) were added 300 ml of acetone and 60 g of potassium carbonate. The mixture was stirred at room temperature for 30 minutes. After completion of the reaction, 60 ml of acetic acid was gradually added to the system. 60 ml of water was then added to the system. The reaction system was then stirred for crystallization. The resulting crystal was filtered off, dissolved in dichloromethane, and then purified through column chromatography to obtain 12 g of Exemplary Compound 1. (Yield: 31%)

Dye A

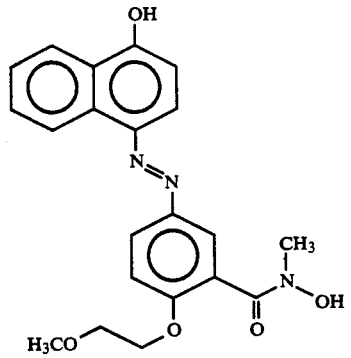

The compound of general formula (I) may be incorporated in a light-sensitive layer or other constituent layer (e.g., protective layer, intermediate layer, filter layer, antihalation layer, image-receiving layer). Two compounds of the present invention containing different photographically useful groups may be used. For example, the combined use of a compound containing PUG which is a diffusive dye and a compound containing PUG which is a development inhibitor provides a transfer dye image with a good S/N ratio.

The compound of general formula (I) can be used in a wide range of amounts. The optimum amount of the present compound to be used depends on the type of PUG. For example, if PUG is a diffusive dye, it is in the range of 0.05 mmol/m$^2$ to 50 mmol/m$^2$, preferably 0.1 mmol/m$^2$ to 5 mmol/m$^2$, though depending on the extinction coefficient of the dye. If PUG is a development inhibitor, it is preferably in the range of $1\times10^{-7}$ mol to $1\times10^{-1}$ mol, particularly $1\times10^{-6}$ to $1\times10^{-2}$ mol per mol of silver halide. Further, if PUG is a development accelerator or nucleating agent, it is preferably used in the same range of amount. If PUG is a silver halide solvent, it is preferably used in an amount of $1\times10^{-5}$ mol to $1\times10^{3}$ mol, particularly $1\times10^{-4}$ mol to $1\times10^{1}$ mol per mol of silver halide.

The compound of general formula (I) receives electrons from a reducing substance to release a photographically useful group or precursor thereof. Therefore, if a reducing substance is uniformly acted on the compound of general formula (I), a photographically useful group or precursor can be uniformly released. If a reducing substance is imagewise oxidized, a photographically useful group or precursor thereof can be counterimagewise released.

In this case, the photographically useful group may not only perform its function after being released but also may perform its function before being released and reduce or eliminate its function after being released. It is also possible that as a result of counterimagewise elution of the compound of general formula (I) due to the increase in the water solubility of PUG by the change in the physical properties thereof during release, the compound which has imagewise remained act on the system.

In other words, the compound of general formula (I) can uniformly, counterimagewise or imagewise act on the development of silver. Therefore, unlimited applications are possible. Examples of these applications are set forth below, and specific examples of applications are set forth in Table 1, but general formula (I) should not be construed as being limited thereto.

1. If in the compound of general formula (I), the photographically useful group is a diffusive dye, the diffusion transfer process or sublimation transfer process can be used to form color images. In this case, if a negative emulsion is used, a positive image can be obtained while if an auto positive emulsion is used, a negative image can be obtained.

2. If in the compound of general formula (I), the photographically useful group is a colorless compound or a dye whose absorption wavelength has been altered before being released but colored or discolored after being released, the color of the system can be changed after being released. Therefore, this phenomenon can be used to form an image.

3. If in the compound of general formula (I), the photographically useful group is a fog inhibitor, the fog inhibitor is released in a large amount at the undeveloped portion of the material as compared to the developed portion, enabling an effective inhibition of fog without causing a decrease in the sensitivity, which is normally undesirable in the art. In this case, either an auto positive emulsion and a negative emulsion can be used to attain the same effect.

TABLE 1

| | | Examples of photographic functions | |
|---|---|---|---|
| No. | Type of PUG | Totally released | Released in counter correspondence to development of AgX |
| 1 | Image-forming dye | — | Positive-positive dye image formation system |

TABLE 1-continued

| No. | Type of PUG | Examples of photographic functions: Totally released | Released in counter correspondence to development of AgX |
|---|---|---|---|
| 2 | Photographic dye (YF*, AH*, etc.) | Substitute for YFE*, dyeing by layer, improvement in color reproducibility, improvement in sharpness, adjustment of sensitivity | Improvement in silver image, improvement in sharpness |
| 3 | UV absorbent | Improvement in color reproducibility | Adjustment of sensitivity, adjustment of gradation |
| 4 | Fluorescent brightening agent | Enhancement of whiteness of white background, acceleration of desilvering | Improvement in S/N ratio by enhancement of whiteness of nonimage portion only |
| 5 | Oxidation inhibitor | Inhibition of stain, inhibition of discoloration | Inhibition of stain |
| 6 | Masking dye | — | Improvement in color reproducibility |
| 7 | Development inhibitor, fog inhibitor | Reduction in Dmin, development stop | Improvement in graininess, improvement in sharpness, adjustment of halftone gradation |
| 8 | Silver halide solvent | Acceleration of development | Improvement in sharpness |
| 9 | Development accelerator | Acceleration of development | Adjustment of gradation, adjustment of sensitivity |
| 10 | Nucleating agent | Acceleration of nucleation, acceleration of development | Adjustment of gradation |
| 11 | Fexation accelerator | Acceleration of fixation | Acceleration of fixation |
| 12 | Reducing agent | Inhibition of color stain, acceleration of development improvement in graininess, adjustment of gradation | Inhibition of color stain, improvement in graininess, adjustment of gradation |
| 13 | Silver image toner | Color toning | Color toning |
| 14 | Film quality improver | Acceleration of development, enhancement of silver image covering power | Acceleration of development |
| 15 | Toe cutting agent | Development of contrast | Adjustment of gradation |
| 16 | Bleach acceleration | Acceleration of bleach | Acceleration of bleach |
| 17 | Charge-fading polymer | Dyeing by layer (substitute for YFE, AH, inhibition of irradiation) | Color image formation system |
| 18 | Polymer eluting upon processing | Enhancement of covering power | Formation of relief |

*YF: Yellow Filter AH: Antihalation YFE: Yellow Filter Emulsion

The compound of general formula (I) can find many applications as described above. Further, the compound of general formula (I) exhibits excellent properties as compared to conventional compound groups performing similar functions.

Thus, the compound of general formula (I) can release a photographically useful group at a sufficiently high rate even at a temperature of −20° C. or lower and undergoes little decomposition at an elevated temperature. Therefore, the compound of general formula (I) can be used in an extremely wide temperature range. Further, the compound of general formula (I) can be used in almost all pH conditions under which a reduction reaction is possible. Taking into account photographic practicability, the optimum temperature range is between −20° C. and 180° C., and the optimum pH range is between 6.0 and 14.0.

The compound of general formula (I) is oxidative and thus stays completely stable during the storage of the light-sensitive material and in a oxidative atmosphere. Therefore, the light-sensitive material of general formula (I) exhibits an extremely excellent storage stability.

A further advantage of the compound of general formula (I) is that the compounds produced by the reduction thereof upon processing, i.e., the reduction products of the compound of general formula (I) are chemically inert, exerting no adverse side effects upon processing and no adverse effects on the stability of photographic properties such as image stability.

The compound of general formula (I) and various additives as mentioned hereinafter, if they are water-soluble, can be incorporated into a hydrophilic colloidal coating a solution in the form of solution in water or an organic solvent miscible with water. If latex-dispersed, the compound of general formula (I) can be directly incorporated into a hydrophilic colloidal coating solution. Further, if the compound of general formula (I) is an oil-soluble high molecular compound, it can be dispersed in a hydrophilic colloidal coating solution by any commonly used dispersion process (e.g., oil dispersion process, Fischer's dispersion process, polymer dispersion). Moreover, solid dispersion process can be used without using any solvent.

Examples of high boiling organic solvents to be used in the oil dispersion process include phthalic alkyl esters (e.g., dibutyl phthalate, dioctyl phthalate), phosphoric esters (e.g., diphenyl phosphate, triphenyl phosphate, tricyclohexyl phosphate, tricresyl phosphate, dioctyl butyl phosphate), citric esters (e.g., tributyl acetylcitrate), benzoic esters (e.g., benzoic octyl), alkyl amides (e.g., diethyl lauryl amide), aliphatic esters (e.g., dibutoxy ethyl succinate, dioctyl azerate), trimesic esters (e.g., tributyl mesicate), carboxylic acids as disclosed in Japanese Patent Application No. 61- 231500, and compounds as disclosed in JP-A-59-83154, 59- 178451, 59-178452, 59-178453, 59-178454, 59-178455, and 59-178457. Further, nondiffusive carboxylic acid derivatives represented by general formula (a) can be used:

$$(R^4\text{—}COO)_nM^{n+} \qquad \text{(a)}$$

wherein $R^4$ represents a substituent which provides the compound of general formula (a) with nondiffusivity; $M^{n+}$ represents a hydrogen ion, a metal ion or an ammonium ion; and n represents an integer from 1 to 4.

The group represented by $R^4$ which provides the compound of general formula (a) with nondiffusivity has 8 to 40 carbon atoms, preferably 12 to 32 carbon atoms.

Specific examples of the compound of general formula (a) are set forth below:

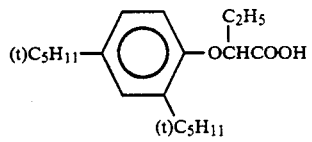
(a-1)

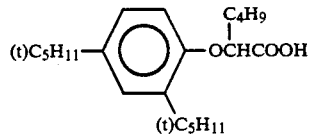
(a-2)

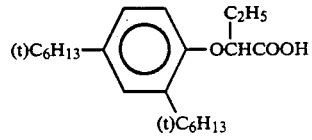
(a-3)

$C_{17}H_{35}COO^-NH_4^+$ (a-4)

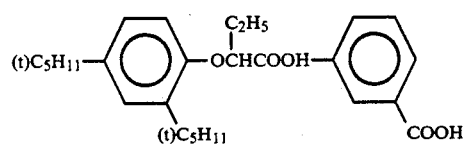
(a-5)

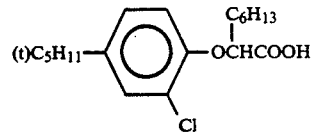
(a-6)

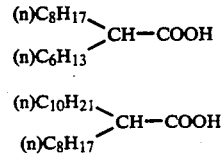
(a-7)

(a-8)

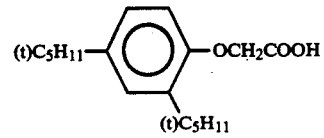
(a-9)

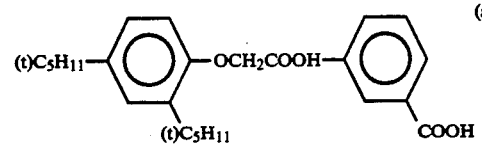
(a-10)

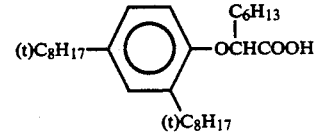
(a-11)

An organic solvent having a boiling point of about 30° to 160° C. such as a lower alkyl acetate (e.g., ethyl acetate, butyl acetate). ethyl propionate, tertiary butyl alcohol, methyl isobutyl ketone, β-ethoxy ethyl acetate, methyl cellosolve acetate and cyclohexanone can be used instead of or in combination with these high organic solvents. After dispersion, the low boiling organic solvent can be optionally removed from the system by ultrafiltration before use.

On the other hand, in the solid dispersion process, the compound of general formula (I) is dispersed in a hydrophilic colloid in the form of finely divided grains. The fine grinding of the compound can be accomplished by means of a known mill. The shearing strength must be small enough to reduce the grain size of the material to a predetermined value within a predetermined period of time. The processing method and mill to be used in the solid dispersion process are further described in U.S. Pat. Nos. 2,581,414, and 2,855,156, and JP-A-52-110012.

The reducing substance to be used to release PUG from the compound of general formula (I) may be either an inorganic compound or an organic compound. The oxidation potential of the reducing substance is preferably lower than the reference redox potential of silver ion/silver (0.80 V).

Examples of such organic compounds include metals with an oxidation potential of 0,8 V or less, such as Mn, Ti, Si, Zn, Cr, Fe, Co, Mo, Sn, Pb, W, $H_2$, Sb, Cu, and Hg, ions or complex thereof with an oxidation potential of 0.8 V or less, such as $Cr^{2+}$, $V^{2+}$, $Cu^{2+}$, $Fe^{2+}$, $MnO_4^{2-}$, $I-Co(CN)_6^{4-}$, $Fe(CN_6^{4-}$, and $(Fe\text{-}EDTA)^{2-}$, hydrogenated metal compounds with an oxidation potential of 0.8 V or less, such as NaH, LiH, KH, $NaBH_4$, $LiBH_4$, $LiAl(O\text{-}t\text{-}C_4H_0)_3H$, and $LiAl(OCH_3)_3H$, and sulfur or phosphorus compounds with an oxidation potential of 0.8 V or less, such as $Na_2SO_3$, NaHS, $NaHSO_3$, $H_3P$, $H_2S$, $Na_2S$, and $Ha_2S_2$.

The organic reducing substances can be organic nitorgen compounds such as alkylamine and arylamine, organic sulfur compounds such as alkyl mercaptane and aryl mercaptane or organic phosphorus compounds such as alkyl phosphine and aryl phosphine. Silver halide reducing agents according to Kendal-Pelz's equation as described in James, *The Theory of the Photographic Process*, 4th ed., page 299 (1977), are preferably used.

Preferred examples of the reducing agents include 3-pyrazolidones and precursors thereof (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-methyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1(4-toly)-4-methyl-3-pyrazolidone, 1-(2-tolyl)-4-methyl-3-pyrazolidione, 1-(4-toly)3-pyrazolidione, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis-(lauroyloxymethyl)-3-pyrazolidone, 1-phenyl-3-acetoxypyrazolidone), and hydroquinones and precursor thereof (e.g., hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzooxyphenol, 2-t-butyl-4-(4-chlorobenzoyloxy)phenol).

Other examples of silver halide reducing agents include color developing agents such as pphenylene color developing agent typified by N,N-diethyl-3-methyl-p-phenylenediamine as described in U.S. Pat. No. 3,531,286. Further useful examples of reducing agents include the aminophenol as described in U.S. Pat. No. 3,761,270. Particularly useful among aminophenol reducing agents are 4-amino-2,6-dichlorophenol, 4-amino-2,6-dibromophenol, 4-amino-2-methylphenol sulfate, 4-amino3-methylphenol sulfate, and 4-amino-2,6-dichlorophenol hydride. Further useful examples of the reducing agents include 2,6-dichloro-4-substituted-sulfonamide phenol and 2,6-dibromo-4-substituted sulfonamide phenol as disclosed in Research Disclosure No. 15108 and U.S. Pat. No. 4,021,240, and p-(N,N-dialkylaminophenyl)sulfamine as disclosed in JP-A-59-16740. In addition to the above mentioned phenolic reducing agents, naphtholic reducing agents such as 4-amino-naphthol derivatives and 4-substituted sulfonamide naphthol derivatives as disclosed in Japanese Patent Application No. 60-100380 are particularly useful. Examples of common color developing agents which can be used include aminohydroxypyrazole derivatives as disclosed in U.S. Pat. No. 2,895,825, aminopyrazolidone derivatives as disclosed in U.S. Pat. No. 2,892,714, and hydrazone derivatives as disclosed in Research Disclosure Nos. 19412 and 19415 , June 1980, pp. 227–230, and pp. 236–240. These color developing agents can be used singly or in combination.

If a nondiffusive reducing substance (ED: electron donor) is incorporated in the light-sensitive material as the reducing substance, an electron transfer agent (ETA) is preferably used in combination therewith to accelerate the electron migration between the reducing agent and the developable silver halide emulsion. The electron donor and/or electron transfer agent may be used in the form of precursor. Alternatively, the electron donor may be used in combination with the electron transfer agent and its precursor.

Preferred examples of electron donors include compounds represented by general formulae (b) and (c):

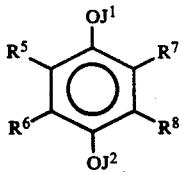

(b)

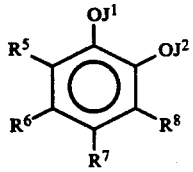

(c)

wherein $J^1$ and $J^2$ each represents a hydrogen atom or a phenolic hydroxylic protective group capable of being removed the compound by interaction with a nucleophilic reagent.

Examples of such a nucleophilic reagent includes $OH^-$, $RO^-$, (in which R represents an alkyl group, aryl group, etc.), anionic reagents such as hydroxamic anions $SO_3^{2-}$, and compounds having unshared electron pair such as primary or secondary amines, hydrazine, hydroxylamines, alcohols, and thiols. Preferred examples of $J^1$ and $J^2$ include a hydrogen atom, an acyl group, an alkylsulfonyl group, an arylsulfonyl group, an alkoxycarbonyl group, an aryloxycarbonyl group, a dialkylphosphoryl group, a diarylphosphoryl group, and aprotective groups as disclosed in JP-A-59-197037 and 59-20105. $A_1$ and $A_2$ may be optionally connected to $R^5$, $R^6$, $R^7$ and $R^8$ to form a ring. $J^1$ and $J^2$ may be the same or different.

$R^5$, $R^6$, $R^7$ and $R^8$ each represents a hydrogen atom, an alkyl group (e.g., an alkyl group which may be substituted, such as methyl, ethyl, n-butyl, cyclohexyl, n-octyl, allyl, sec-octyl, tert-octyl, n-dodecyl, n-pentadecyl, n-hexdecyl, tert-octadecyl, 3-hexadecanoylaminophenylmethyl, 4-hexadecylsulfonylaminophenylmethyl, 2-ethoxycarbonylethyl, 3-carboxypropyl, N-ethylhexadecylsulfonylaminomethyl, N-methyldodecylsulfonylaminoethyl), an aryl group (e.g., an aryl group which may be substituted, such as phenyl, 3-hexadecyloxyphenyl, 3-methoxyphenyl, 3-sulfophenyl, 3-chlorophenyl, 2-carboxyphenyl, 3-dodecanoylaminophenyl), an alkylthio group (e.g., an alkylthio group which may be substituted, such as n-butylthio, methylthio, tert-octylthio, n-dodecylthio, 2-hydroxyethylthio, n-hexadecylthio, 3-ethoxycarbonylpropylthio), an arylthio group (e.g., an arylthio group which may be substituted, such as phenylthio, 4-chlorophenylthio, 2-n-octyloxy-5-t-butylphenylthio, 4-dodecyloxyphenylthio, 4-hexadecanoylaminophenylthio), a sulfonyl group (e.g., an aryl or alkylsulfonyl group which may be substituted, such as methanesulfonyl, butanesulfonyl, p-toluenesulfonyl, 4-dodecyloxyphenylsulfonyl, 4-acetylaminophenylsulfonyl), a sulfo group, a halogen atom (e.g., fluorine, chlorine, bromine, iodine), a cyano group, a carbamoyl group (e.g., a carbamoyl group which may be substituted, such as methyl carbamoyl, diethyl carbamoyl, 3-2,4-di-t-pentylphenyloxy)propyl carbamoyl, cyclohexyl carbamoyl, di-n-octylcarbamoyl), a sulfamoyl group (e.g., a sulfamoyl group which may be substituted, such as diethyl sulfamoyl, di-n-octylsulfamoyl, n-hexadecylsulfamoyl, 3-isohexadecanoylaminophenylsulfamoyl), an amide group (e.g., an amide group which may be substituted, such as acetamide, isobutyloylamino, 4-tetradecyloxyphenylbenzamide, 3-hexadecanoylaminobenzamide), an amide group (e.g., an imide group which may be substituted, such as imide succinate, imide 3-laurylsuccinate, phthalimide), a carboxyl group, or a sulfonamide group (e.g., a sulfonamide group which may be substituted, such as methanesulfonamide, octanesulfonamide, hexadecanesulfonamide, benzenesulfonamide, toluenesulfonamide, 4-lauryloxybenzenesulfonamide). The number of carbon atoms contained in $R^5$ to $R^8$ is 8 or more. In general formula (b), $R^5$ and $R^6$ and/or $R^7$ and $R^8$ may be connected to each other to form a saturated or unsaturated ring. In general formula (c), $R^5$ and $R^6$, $R^6$ and $R^7$ and/or $R^7$ and $R^8$ may be connected to each other to form a saturated or unsaturated ring.

In the electron donor represented by general formula (b) or (c), at least two of $R^5$ to $R^8$ are preferably substituents other than a hydrogen atom. Particularly preferred among these electron donors are those wherein at least one $R^5$ and $R^6$ and at least one of $R^7$ and $R^8$ are substituents other than hydrogen atom.

A plurality of such electron donors can be used in combination. Such an electron donor may be used in combination with precursors thereof. Such an electron donor may be the same compound as the reducing substance of the present invention.

Specific examples of such electron donors are set forth below, but the present invention should not be constred as being limited thereto:

(ED-1)

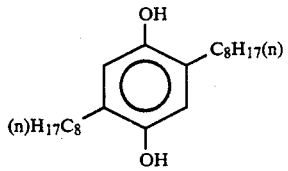

(ED-2)

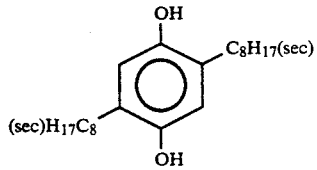

(ED-3)

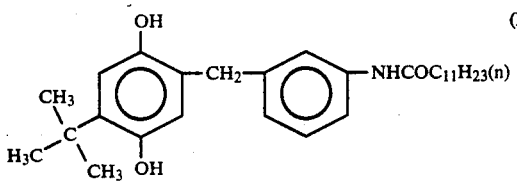

(ED-4)

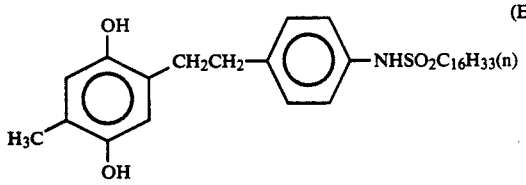

(ED-5)

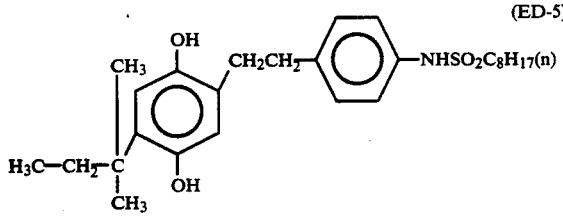

(ED-6)

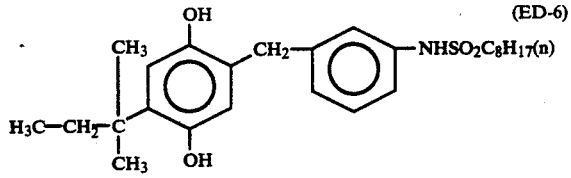

(ED-7)

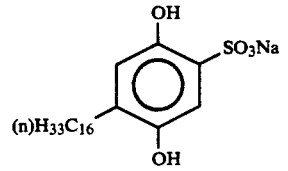

-continued (ED-8)

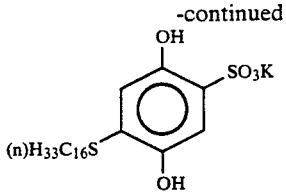

(ED-9)

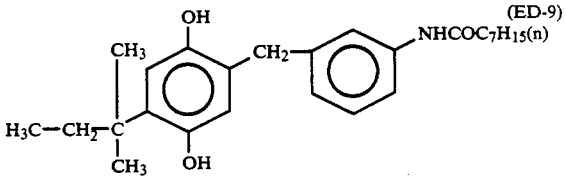

(ED-10)

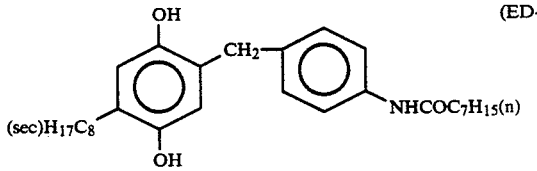

(ED-11)

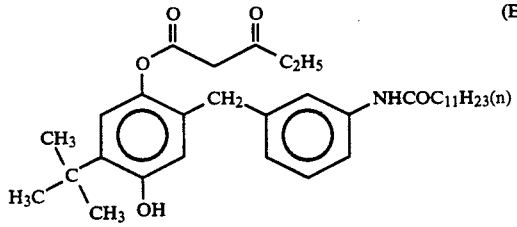

(ED-12)

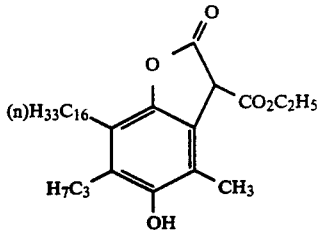

For the purpose of enhancing storage stability, these electron donors may be previously oxidized before being incorporated into the light-sensitive material.

The reducing substance (including an electron donor or its precursor) can be used in an amount over a wide range. Its preferred amount is in the range of 0.01 to 50 mol, particularly 0.1 to 5 mol per mol of the compound of general formula (I), or 0.001 to 5 mol, preferably 0.01 to 1.5 mol per mol of silver halide.

The ETA to be used in combination with such an electron donor can be any compound which can be oxidized by silver halide to give an oxidation product which has a capability to cross-oxidize the electron donor. Mobile ETA are preferred.

Particularly preferred examples of ETA include compounds represented by general formulae (d) and (e):

(d)

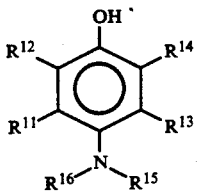

-continued (e)

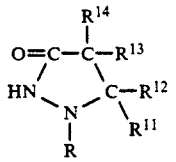

wherein R represents an aryl group; and $R^{11}$, $R^{12}$, $R^{13}$, $R^{14}$, $R^{15}$ and $R^{16}$ may be the same or different and each represents a hydrogen atom, a halogen atom, an acylamino group, an alkoxy group, an alkylthio group, an alkyl group or an aryl group.

Examples of the aryl group represented by R in general formula (d) or (e) include a phenyl group, a naphthyl group, a tolyl group, and a xylyl group. These groups may be substituted by a halogen atom (e.g., chlorine, bromine), an amino group, an alkoxy group, an aryloxy group, a hydroxyl group, an aryl group, a carbonamide group, a sulfonamide group, an alkanoyloxy group, a benzoyloxy group, a ureide group, a carbamate group, a carbamoyloxy group, a carbonate group, a carboxyl group, a sulfo group, an alkyl group (e.g., methyl, ethyl, propyl) or the like.

The alkyl group represented by $R^{11}$, $R^{12}$, $R^{13}$, $R^{14}$, $R^{15}$ or $R^{16}$ in general formula (d) or (e) is a $C_{1-10}$ alkyl group (e.g., methyl, ethyl, propyl, butyl). Such an alkyl group may be substituted by a hydroxyl group, an amino group, a sulfo group, a carboxyl group, etc. Examples of the aryl group represented by R include a phenyl group, a naphthyl group, a xylyl group, and a tolyl group. These aryl groups may be substituted by a halogen atom (e.g., chlorine, bromine), an alkyl group (e.g., methyl, ethyl, propyl), a hydroxyl group, an alkoxy group (e.g., methoxy, ethoxy), a sulfo group, a carboxyl group, etc. In the present invention, the compound represented by general formula (e) is particularly preferred. In general formula (e), $R^{11}$, $R^{12}$, $R^{13}$ and $R^{14}$ each is preferably a hydrogen atom, a $C_{1-10}$ alkyl group, a $C_{1-10}$ substituted alkyl group, or a substituted or unsubstituted aryl group, more preferably a hydrogen atom, a methyl group, a hydroxymethyl group, a phenyl group or a phenyl group substituted by hydrophilic group such as a hydroxyl group, an alkoxy group, a sulfo group and a carboxyl group.

Specific examples of ETA compounds represented by general formulae (d) and (e) are set forth below:

(ETA-1)

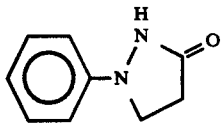

(ETA-2)

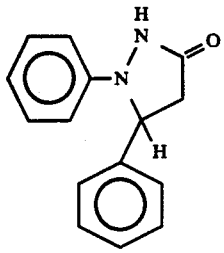

-continued (ETA-3)

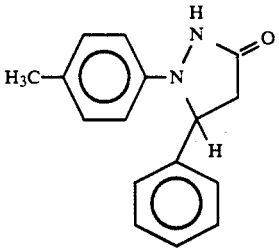

(ETA-4)

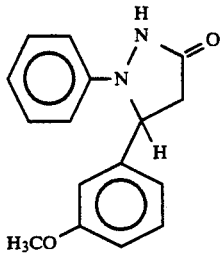

(ETA-5)

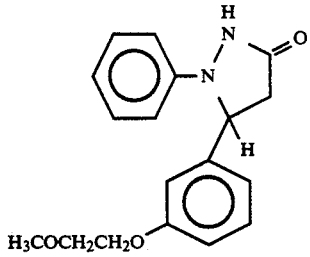

(ETA-6)

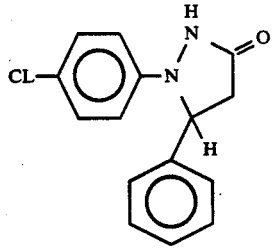

(ETA-7)

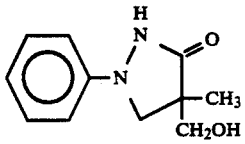

(ETA-8)

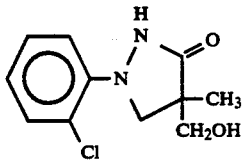

(ETA-9)

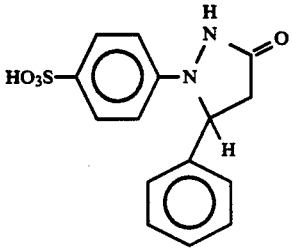

-continued (ETA-10)

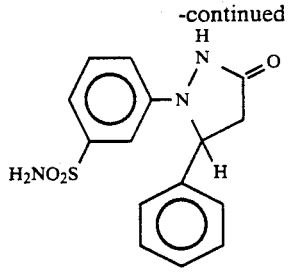

The ETA precursor to be used in the present invention is a compound which exhibits no developing effect during the storage of the light-sensitive material before use but releases ETA only when acted on by a proper activator (e.g., base, nucleophilic reagent) or heated.

In particular, the ETA precursor to be used in the present invention contains reactive functional groups of ETA blocked by blocking groups. Thus, it doesn,t serve as an ETA before development but serves as ETA when processed under alkaline conditions or heated to cause cleavage of the blocking groups. Examples of the ETA precursors to be used in the present invention include 2- and 3-acyl derivatives of 1-phenyl-3-pyrazolidinone, 2-aminoalkyl or hydroxylalkyl derivatives, salts of hydroquinone and catechol with metal (e.g., lead, cadmium, calcium, barium), halogenated acyl derivatives of hydroquinone, oxazine and bisoxazine derivatives of hydroquinone, lactone type ETA precursors, hydroquinone precursors containing quaternary ammonium groups, cyclohexyl-2-ene- 1,4-dione type compounds, compounds which undergo an electron migration reaction to release ETA, compounds which undergo an intramolecular nucleophilic substitution reaction to release ETA, ETA precursors blocked by phthalide group, and ETA precursors blocked by an indomethyl group.

The ETA precursors which can be used in the present invention are known compounds such as the developing agent precursors as disclosed in U.S. Pat. Nos. 767,704, 3,241,967, 3,246,988, 3,295,978, 3,462,266, 3,586,506, 3,615,439, 3,650,749, 4,209,580, 4,330,617, and 4,310,612, British Patents 1,023,701, 1,231,830, 1,258,924, and 1,346,920, and JP-A-57-40245, 58-1139, 58-1140, 59-178458, 59-182449, and 59-182450.

In particular, precursors of 1-phenyl-3-pyrazolidiones as disclosed in JP-A-59-178458, 59-182449, and 59-182450 are preferred.

The light-sensitive material of the present invention can be used as conventional light-sensitive material which is developed with a developer in the vicinity of ordinary temperature or heat-developable light-sensitive material.

If the light-sensitive material of the present invention is used as a conventional light-sensitive material, the above-mentioned reducing substance may be applied by being incorporated into the light-sensitive material or being added in a developer. The preferred process in which the reducing substance acts on the light-sensitive material is a process in which the reducing substance is supplied into the light-sensitive material in the form of developer or a process in which an electron donor and/or a precursor thereof has been previously incorporated into the light-sensitive material and ETA and/or precursor thereof is supplied to the light-sensitive material in the form of developer. In the former process, the preferred amount of the total reducing substances to be used is in the range of 0.001 to 1 mol/l calculated in terms of concentration in the total solution. In the latter process, the preferred total amount of electron donor and/or its precursor to be used is in the range of 0.01 to 50 mol per mol of the compound of general formula (I). The preferred total amount of ETA and/or its precursor to be used is in the range of 0.001 to 1 mol/l as calculated in terms of concentration in the total solution.

If the light-sensitive material of the present invention is used as a heat-developable light-sensitive material, it is preferred that an electron donor and/or its precursor and ETA and/or its precursor are incorporated into the light-sensitive material.

The electron donor and/or its precursor and EAT and/or its precursor may be incorporated into the same or different layers and may be incorporated into the same layer as the compound of general formula (I) or different layers from the compound of genral formula (I). The nondiffusive electron donor and/or precursor thereof is preferably present in the same layer as the compound of general formula (I). ETA and/or precursor thereof may be incorporated in an image-receiving material (dye-fixing material). If it is desired to allow a slight amount of water to present upon development, ETA and/or precursor thereof may be incorporated in the system in the form of aqueous solution. The total amount of the reducing substance to be used is preferably from 0.01 to 50 mol, more preferably from 0.1 to 5 mol per mol, of the compound of general formula (I), or preferably from 0.001 to 5 mol, more preferably from 0.01 to 1.5 mol, per mol of silver halide.

Further, the content of ETA and/or precursor thereof is in the range of 60 mol % or less, preferably 40 mol % or less, of the total weight of the reducing substance. If ETA and/or precursor thereof is supplied in the form of an aqueous solution, its concentration is preferably in the range of $10^{-4}$ mol/l to 1 mol/l.

If the reducing substance has been previously incorporated into the light-sensitive material as mentioned above, action is preferably taken so as to prevent a reaction between the compound of general formula (I) and the reducing substance during the storage of the light-sensitive material to enhance the storage stability thereof. One of these measures is to use reducing substance precursors (e.g., electron donor or oxidation product thereof, ETA precursor). Another measure is to isolate the compound of general formula (I) from at least a part of the reducing substance by microcapsule wall. Examples of such a measure include the embodiments set forth in Table 2.

TABLE 2

| | Inside microcapsule | Outside microcapsule |
|---|---|---|
| A | Compound of general formula (I) | Reducing agent |
| B | Reducing agent | Compound of genral formula (I) |
| C | Reducing agent | Compound of general formula (I) + reducing agent |
| D | Compound of general formula (I) + Reducing agent | Reducing agent |

If a plurality of reducing agents (reducing substances) are used, only a specific reducing agent may be isolated from the compound of general formula (I) by the wall of microcapsules or at least part of each of the reducing agents may be isolated from the compound of general formula (I) by the wall of microcapsules. In particular, nondiffusive reducing agents (e.g., the above mentioned electron donor) are preferably isolated from the compound of general formula (I). In order to expedite the diffusion of the photographically useful group (e.g., dye) released, the compound of general formula (I) is preferably present outside the microcapsules.

The light-sensitive silver halides, binders, and various additives as described later may be present either inside or outside the microcapsules.

The microcapsules can be prepared by any method known in the art. Examples of such a method include a method utilizing coarservation as disclosed in U.S. Pat. Nos. 2,800,457 and 2,800,458, an interfacial polymerization process as disclosed in U.S. Pat. No. 3,287,154, British Patent 990,443, and JP-B-38-19574, 42-446, and 42-771 (the term "JP-B" as used herein means an "unexamined published Japanese patent application"), a method by the deposition of polymer as disclosed in U.S. Pat. Nos. 3,418,250, and 3,660,304, a method using isocyanate polyol wall material as disclosed in U.S. Pat. No. 3,796,669, a method using isocyanate wall material as disclosed in U.S. Pat. No. 3,914,511, a method using urea-formaldehyde or urea-formaldehyde-resorcinol wall-forming material as disclosed in U.S. Pat. Nos. 4,001,140, 4,087,376, and 4,089,802, a method using a wall-forming material such as melamine-formaldehyde resin and hydroxypropyl cellulose as disclosed in U.S. Pat. No. 4,025,455, an in situ process by monomer polymerization as disclosed in JP-B-36-9163 and JP-A-51-9079, an electrolytic dispersion cooling process as disclosed in British Patents 952,807 and 965,074, and a sprayed wing process as disclosed in U.S. Pat. No. 3,111,407 and British Patent 930,422. The present invention should not be construed as being limited thereto. In a preferred process, a high molecular film is preferably formed as microcapsule wall after emulsification of core substance.

The microcapsule wall of the present invention can be prepared by a microcapsulization process in which the polymerization of the reactants from the inside of oil drops is effected to exert its maximum effect. In particular, the microcapsulization process can provide capsules with a uniform grain diameter suitable for light-sensitive material having an excellent fresh storability within a short period of time.

For example, if a polyurethane is used as the capsule wall material, a polyvalent isocyanate and a second substance which reacts with the polyvalent isocyanate to form a capsule wall (e.g., polyol, polyamine) are mixed in an oily liquid, emulsion-dispersed in water, and then heated so that a high molecular compound formation reaction occurs at the interface of the oil drops to form a microcapsule wall. The oily solution may contain an auxiliary solvent with a low boiling point and a high dissolving power.

Examples of such a polyvalent isocyanate and a polyol or polyamine which reacts therewith are disclosed in U.S. Pat. Nos. 3,281,383, 3,773,695, and 3,793,268, JP-B-48-40347 and 49-34159, and JP-A-48-80191, 48-84086, and 60-49991. These compounds can be used in the present invention.

A water-soluble high molecular compound can be used to prepare microcapsules. Such a water-soluble high molecular compound may be anionic, nonionic or amphoteric.

Such a water-soluble high molecular compound is used in the form of a 0.01 to 10 wt.% aqueous solution. The grain diameter of the microcapsules is adjusted to 20 μm or less.

The grain size of the microcapsules to be used in the present invention is in the range of 80 μm or less, particularly 20 μm or less, in view of preservability and handleability.

In order to further enhance the storage stability of the compound of general formula (I) in the light-sensitive material, the pH value of the film in the light-sensitive material during the storage thereof should be kept to 7 or less, particularly 4 to 7. The film pH value can be determined by dropping 20 μl of water onto the film surface of the light-sensitive material and measuring the pH value at equilibrium with a pH electrode having a flat tip (sensor portion) brought into close contact with the water drops.

It is an unexpected fact that the fluctuation of photographic properties during ageing can be drastically inhibited without little inhibition of development by keeping the pH value of the film in the light-sensitive material.

An acid or salt thereof can be used to keep the film pH value of the light-sensitive material in the range of 4 to 7. The acid is preferably one with an acid dissociation constant pKa of 7 or less, more preferably 5 or less. Such an acid is described in "Kagaku Binran (Chemical Handbook)"(basic edition), 1975, pp. 993-1,000 (1975). Heat-decomposable carboxylic acids can be also used. Specific examples of such a heat-decomposable carboxylic acid are further described in JP-A-61-42650.

Further, polymers made of polystyrenesulfonic acid, polyacrylic acid and derivatives thereof can be used. To inhibit of contamination by elution into a processing solution such as a developer, these polymers each have a molecular weight of 1,000 or more, preferablably 5,000 or more.

The silver halide to be used in the present invention may be silver chloride, silver bromide, silver iodide, silver bromochloride, silver bromoiodide or silver bromochloroiodide. The silver halide grain may be uniform in halogen composition. Alternatively, the silver halide grain may have a multi-layer structure in which the surface thereof differs from the core thereof in halogen composition as disclosed in JP-A-57-154232, 58-108533, 59-48755, and 59-52237, U.S. Pat. No. 4,433,048, and European Patent 100,984. Tabular grains with a thickness of 0.5 μm or less, a diameter of at least 0.6 μm and an average aspect ratio of 5 or more as disclosed in U.S. Pat. Nos. 4,414,310, and 4,435,499, and West German Patent Disclosure (OLS) 3,241,310 can be used in the present invention. Further, a monodisperse emulsion with a nearly uniform grain size distribution as disclosed in JP-A-57-178235, 58-100846, and 58-14829, International Patent Disclosure 83/02338Al, and European Patents 64,412A3 and 83,377Al can also be used in the present invention. Two or more silver halide grains with different crystal habits, halogen compositions, grain sizes, grain size distributions, etc. may be used in combination. Two or more monodisperse emulsions with different grain sizes can be mixed to adjust gradation.

The average diameter of the silver halide grains to be used in the present invention is preferably in the range of 0.001 μm to 10 μm, more preferably 0.001 μm to 5 μm. These emulsions can be prepared by the acid process, the neutral process, the ammonia process, etc. The reaction between a soluble silver salt and a soluble halogen salt can be carried out by a single jet process, a double jet process, a combination thereof, and the like. A method in which grains are formed in the presence of excess silver ions, i.e., reverse mixing method may be used. Further, a controlled double jet process, in which the pAg value of the liquid phase in which silver halide grains are formed is maintained constant, may also be used. In order to expedite the growth of grains, the concentration and amount of silver salts and halogen salts to be added and the rate at which they are added may be raised as described in JP-A-55-142329, and 55-158124, and U.S. Pat. No. 3,650,757.

Epitaxial junction type silver halide grains may also be used as disclosed in JP-A-56-16124, and U.S. Pat. No. 4,094,684.

In the step of forming silver halide grains to be used in the present invention, the silver halide solvents used are ammonia, organic thioether derivatives as described in JP-B-47-11386, sulfur-containing compounds as described in JP-A-53-144319, etc.

In the step of formation or physical ripening of grains, cadmium salts, zinc salts, lead salts, thallium salts, etc. may be present in the system.

For the purpose of improving high intensity reciprocity law failure or low intensity reciprocity law failure, a water-soluble iridium salt such as iridium chloride (III, IV) and ammonium hexachloroiridiumate or water-soluble rhodium salt such as rhodium chloride may be used. In particular, the incorporation of iridium in an amount of $10^{-9}$ to $10^{-5}$ mol per mol of silver halide can provide silver halide grains excellent in reciprocity law failure, fogging and gradation.

Soluble salts may be removed from the silver halide emulsion after precipitation or physical ripening. Therefore, the silver halide emulsion can be subjected to noodle rinse or sedimentation process.

The silver halide emulsion may be used unripened but normally used after being chemically sensitized. Emulsions for ordinary type light-sensitive materials may be subjected to known sulfur sensitization process, reduction sensitization process, noble sensitization process, and the like, singly or in combination. These chemical sensitization processes may be effected in the presence of a nitrogen-containing heterocyclic compound as disclosed in JP-A-58-126526 and 58-215644.

The silver halide emulsion to be used in the present invention may be the surface latent image type in which latent images are mainly formed on the surface thereof or the internal latent image type in which latent images are mainly formed thereinside. A direct reversal emulsion comprising a combination of an internal latent image type emulsion and a nucleating agent may be used. Internal latent image type emulsions suitable for this purpose are described in U.S. Pat. Nos. 2,592,250, and 3,761,276, JP-B-58-3534, and JP-A-57-136641. Suitable nucleating agents to be combined with the internal latent image type emulsion of the present invention are described in U.S. Pat. Nos. 3,227,552, 4,245,037, 4,255,511, 4,266,031, and 4,276,364, and OLS 2,635,316.

The emulsion to be used in the present invention is normally subjected to spectral sensitization with a methine dye or other dyes. Examples of the spectral sensitizing dye to be used in the present invention include cyanine dye, melocyanine dye, composite cyanine dye, composite melocyanine dye, holopolar cyanine dye, hemicyanine dye, styrye dye and hemioxonol dye. Particularly useful among these dyes are cyanine dye, melocyanine dye, and composite melocyanine dye. Any nucleus which is commonly used as a basic heterocyclic nucleus for a cyanine dye can be applied to these dyes. Examples of a suitable nucleus which can be applied to these dyes include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus and a nucleus obtained by fusion of alicyclic hydrocarbon rings to these nuclei or a nucleus obtained by fusion of aromatic hydrocarbon rings to these groups, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may contain substituents on their carbon atoms.

Examples of a suitable nucleus which can be applied to melocyanine dye or a composite melocyanine dye include those having a ketomethylene structure such as a 5- or 6-membered heterocyclic nucleus, a pyrazoline-5-one nucleus, a thiohydantoin nucleus, a 2-thiooxazoline-2,4-dione nucleus, a thiazoline-2,4-dione nucleus, a rhodanine nucleus, and a thiobarbituric acid nucleus.

These sensitizing dyes can be used singly or in combination. A combination of sensitizing dyes is often used for the purpose of supersensitization.

In combination with the sensitizing dye, a dye which does not exhibit a spectral sensitizing effect itself or a substance which does not substantially absorb visible light but exhibits a supersensitizing effect can be incorporated into the emulsion. Examples of such a dye or substance include aminostilbenzene compounds substituted by nitrogen-containing heterocyclic groups as described in U.S. Pat. Nos. 2,933,390 90 90 and 3,635,721, aromatic organic acid-formaldehyde condensates as described in U.S. Pat. No. 3,743,510, cadmium salts, and azaindene compounds. Combinations described in U.S. Pat. Nos. 3,615,613, 3,615,641, 3,617,295, and 3,635,721 are particularly useful.

The photographic emulsion to be used in the present invention may comprise a single surface active agent or a mixture of surface active agents.

The surface active agents are used as coating aids but may be often used for other purposes, e.g., emulsion dispersion, sensitization, improvement in photographic properties, antistatic treatment, and inhibition of adhesion. These surface active agents can be divided into many groups, i.e., natural surface active agents such as saponin, nonionic surface active agents such as alkylene oxide, grlycerin and glycidol, cationic surface active agents such as higher alkyl amine, quaternary ammonium salt, pyridine, other heterocyclic groups, phosphonium and sulfonium, anionic surface active agents containing an acid group such as carboxylic acid, sulfonic acid, phosphoric acid, sulfuric ester and phosphoric ester, and amphoteric surface active agents such as amino acid, aminosulfonic acid and sulfuric or phosphoric ester of aminoalcohol.

The photographic emulsion to be used in the present invention may comprise various compounds for the purpose of inhibiting fogging during the preparation, storage and photographic processing of the light-sensitive material or stabilizing the photographic properties thereof. Examples of these compounds include development inhibitors as disclosed herein with reference to PUG.

The photographic emulsion layer in the photographic light-sensitive material of the present invention may comprise thioether compounds, thiomorpholines, quaternary ammonium salt compounds, urethane derivatives, imidazole derivatives, 3-pyrazolidones, etc., to enhance sensitivity and contrast or to accelerate development.

The photographic light-sensitive material to be used in the present invention may comprise a water-insoluble or difficultly-soluble synthetic polymer dispersion in the photographic emulsion layer or in other hydrophilic colloidal layers for the purpose of improving the dimensional stability thereof or like purposes. For example, polymers can be used comprising as monomeric units alkyl (meth)acrylate, alkoxyacryl (meth)acrylate, glycidyl (meth)acrylate, etc., singly or in combination, or in combination thereof with acrylic acid, methacrylic acid, $\alpha$, $\beta$-unsaturated dicarboxylic acid, hydroxyalkyl(meth)acrylate, sulfoalkyl(meth)acrylate, styrenesulfonic acid, etc.

A suitable binder or protective colloid to be incorporated in the emulsion layer or auxiliary layers (e.g., protective layer, interlayer) in the present light-sensitive material is gelatin. Other hydrophilic colloids may be used. Examples of such hydrophilic colloids which can be used in the present invention include protein such as gelatin derivatives, graft polymer of gelatin with other high molecular compounds, albumine, and casein, saccharide derivatives such as hydroxyethyl cellulose, carboxymethyl cellulose, cellulose ester sulfate, sodium alginate, and starch derivative, homopolymer or copolymer such as polyvinyl alcohol, polyvinyl alcohol partial acetal, poly-N-vinyl pyrrolidone, polyacrylic acid, polymethacrylic acid, polyacrylamide, polyvinyl imidazdazole, and polyvinyl pyrazole, and other various synthetic hydrophilic high molecular compounds. Further, lime-treated gelatin, acid-treated gelatin, enzyme-treated gelatin, etc. may be used.

The present light-sensitive material can comprise an inorganic or organic film hardener in the photographic emulsion layer or other hydrophilic colloidal layers. For example, chromium salts (e.g., chrome alum, chromium acetate), aldehydes (e.g., formaldehyde, glyoxal, glutaraldehyde), N-methylol compounds (e.g., dimethylurea, methylol dimethyl hydantoin), dioxane derivatives (e.g., 2,3-dihydroxydioxane), active vinyl compounds (e.g., 1,3,5-triacrylol-hexahydro-s-triazine, 1,3-vinylsulfonyl-2-propanol), active halogen compounds (e.g., 2,4-dichloro-6-hydroxy-s-triazine), and mucohalogenic acids (e.g., mucochloric acid, mucophenoxychloric acid) may be used singly or in combination.

The silver halide photographic material of the present invention may comprise other various additives such as a brightening agent, a dye, a desensitizer, a coating aid, an antistatic agent, a plasticizer, a lubricant, a matting agent, a development accelerator, a mordant, an ultraviolet absorbent, a discoloration inhibitor and a color fog inhibitor.

As these additives there can be used those described in Research Disclosure No. 176 (RD-17643), December 1978, pp. 22 -31.

The compound of general formula (I) can be used for any conventional silver halide photographic materials which is developed with a developer in the vicinity of ordinary temperature. Examples of these silver conventional silver halide photographic materials include black-and-white light-sensitive materials such as X-ray film (e.g., industrial X-ray film, medical indirect X-ray film, medical direct X-ray film), printing light-sensitive material (e.g., film for picture or halftone taking, reversing film, photo-composing film or paper), general-purpose black-and-white photographic paper, black-and-white film for picture taking and scanner film, color light-sensitive materials such as color negative film, color paper, color reversal film, color reversal paper and copying color paper, direct reversal black-and-white or color light-sensitive material, silver salt diffusion transfer light-sensitive material, and color diffusion transfer light-sensitive material.

Printing light-sensitive materials to which the compound of general formula (I) can be applied include lithographic film as well as printing light-sensitive material comprising silver bromochloride or silver bromochloroiodide with a silver chloride content of 60% or more (silver iodide content: 0 to 5%) and polyalkylene oxides as described in U.S. Pat. No. 4,452,882 and printing light-sensitive material which undergoes action by arylhydrazines to form an ultrahigh contrast negative image with a stable developer as described in U.S. Pat. No. 4,224,401.

The color photographic light-sensitive material to which the compound of general formula (I) can be applied normally has a multi-layer structure in which there are at least two spectral sensitivities on a support. Such a multi-layer natural photographic light-sensitive material normally comprises at least one red-sensitive layer, at least one green-sensitive layer and at least one blue-sensitive layer on a support. The order of arrangement of these layers can be arbitrarily selected as necessary. In a preferred embodiment, a red-sensitive emulsion layer, a green-sensitive emulsion layer, and a blue-sensitive emulsion layer or a blue-sensitive emulsion layer, a red-sensitive emulsion layer, and a green-sensitive emulsion layer are arranged in this order as viewed from the support side. Each of these emulsion layers may consist of two or more emulsion layers having different sensitivities. Alternatively, a light-insensitive layer may be interposed between two or more emulsion layers having the same sensitivity. In general, the red-sensitive emulsion layer, green-sensitive emulsion layer and blue-sensitive emulsion layer comprise a cyan-forming coupler, magenta-forming coupler and yellow-forming coupler, respectively. However, different combinations may be used as necessary.

In the present invention, various color couplers can be used. The term "color coupler" as used herein means a compound which undergoes a coupling reaction with an oxidation product of an aromatic primary amine developing agent to form a dye. Typical examples of useful color couplers include naphtholic or phenolic compounds, pyrazolone or pyrazoloazole compounds, and open-chain or heterocyclic ketomethylene compounds. Specific examples of these cyan, magenta and yellow couplers which can be used in the present invention are described in Research Disclosure (RD) 17643, Dec., 1978, VII-D, and 18717, Nov., 1979.

Color couplers to be incorporated into the light-sensitive material preferably contain ballast groups or are polymerized to exhibit nondiffusivity. Two-equivalent couplers substituted by coupling-separatable group are preferred to four-equivalent couplers containing a hydrogen atom in the coupling active position because they can reduce the coated amount of silver. Further, couplers which produce developed dyes having a proper diffusivity, colorless couplers or DIR couplers which undergo a coupling reaction to release a development inhibitor or couplers which undergo a coupling reaction to release a development accelerator can be used.

The ordinary wet photographic processing of the silver halide photographic material of the present invention can be accomplished by any known method. As processing solutions there can be used known processing solutions. The processing temperature can be normally selected from 18° C. to 50° C. but may fall below 18° C. or exceed 50° C. Either development process by which silver images are formed (black-and-white photographic processing) or color photographic processing comprising development for forming dye images can be used depending on the purpose.

These are further described in James, *The Theory of the Photographic Process,* 4th ed., pp. 291–436, and Research Disclosure, December 1978, (RD17643), pp. 28–30.

The fixing solution to be used after black-and- white development there can be the commonly used composition. The fixing agent can be thiosulfate or thiocyanate as well as organic sulfur compounds which are known to serve as a fixing agent. The fixing solution may contain a water-soluble aluminum salt as a film hardener.

The photographic emulsion layer which has been color-developed is normally subjected to bleach. Bleach may be effected simultaneously with or separately of fixing. The bleaching agents can be compounds of polyvalent metals such as iron (III), cobalt (III), chromium (IV) and copper (II), peroxides, quinones, nitroso compounds, etc. For example, ferricyanides, bichromates, organic complexes of iron (III) or cobalt (III) with, e.g., aminopolycarboxylic acids such as ethylenediaminetetraacetic acid, nitrilotriacetic acid and 1,3-diamino-2-propanoltetraacetic acid or organic acids such as citric acid, tartaric acid and maleic acid, persulfates, permanganates, nitrosophenol, etc., may be used. Particularly useful among these compounds are potassium ferricyanide, ferric sodium ethylenediaminetetraacetate, and ferric ammonium ethylenediaminetetraacetate. Complex salts of ferric ethylenediaminetetraacetate are useful in both an independent bleaching bath and a combined bleach and fixing bath.

The bleaching bath or blix bath may comprise bleach accelerators as disclosed in U.S. Pat. Nos. 3,042,520 and 3,241,966, and JP-B-45-8506 and 45-8836, thiol compounds as disclosed in JP-A-53-65732, and other various additives.

The compound of general formula (I) can be applied to a heat-developable light-sensitive material which forms a black-and-white image or coupler dye image. The heat-developable light-sensitive material essentially comprises a light-sensitive silver halide, a binder and a reducing agent on a support, and may optionally contain an organic metal salt oxidizer, a dye-donating compound (reducing agent may also serve as dye-donating compound as described later), etc. The compound of general formula (I) is preferably used as the above mentioned dye-donating compound. These components are mostly incorporated in the same layer but may be separately incorporated in different layers if a reaction is possible. For example, a colored dye-donating compound can be present below a silver halide emulsion layer to inhibit the reduction of sensitivity.

In order to obtain a wide range of colors in a chromaticity diagram from three primaries, i.e., yellow, magenta and cyan, at least three silver halide emulsion layers having sensitivity in their respective different spectrum ranges may be used in combination. For example, a combination of three layers, e.g., blue-sensitive layer, green-sensitive layer and red-sensitive layer or green-sensitive layer, red-sensitive layer and infrared-sensitive layer can be used. These light-sensitive layers may be arranged in various orders known in ordinary color light-sensitive materials. Further, these light-sensitive layers may consist of two or more layers as necessary.

The heat-developable light-sensitive material may comprise various auxiliary layers such as a protective layer, a subbing layer, an interlayer, a yellow filter layer, an antihalation layer, and a backing layer.

In the heat-developable light-sensitive material, the light-sensitive silver halide may be used in combination with an organic metal salt as an oxidizer. In this case, it is necessary that the light-sensitive silver halide and the organic metal salt be in contact with each other or adjacent to each other.

Particularly preferred among these organic metal salts are organic silver salts.

Examples of organic compounds which can be used to form the above mentioned organic silver salt oxidizer include the compounds disclosed in U.S. Pat. No. 4,500,626, columns 52-53. Silver salts with a carboxylic acid containing alkynyl group, such as silver phenylpropiolate as disclosed in JP-A-60-113235 and acetylene silver as disclosed in JP-A-61-249044 are also useful. Two or more organic silver salts may be used in combination.

The above mentioned organic silver salt can be used in an amount of 0.01 to 10 mol, preferably 0.01 to 1 mol, per mol of light-sensitive silver halide. The sum of the coated amount of light-sensitive silver halide and organic silver salt is preferably in the range of 50 mg to 10 g/mz as calculated in terms of silver.

In the present invention, the dye-donating compound to be incorporated in the heat-developable light-sensitive material is preferably a compound represented by general formula (I) wherein PUG is a diffusive dye. A compound represented by general formula (I) wherein PUG is a photographically useful group other than dye (e.g., development inhibitor) may be used, and another compound may be used as dye- donating compound. Examples of such other dye-donating compounds include compounds which undergo an oxidation coupling reaction to form a dye (coupler). These couplers may be either four-equivalent couplers or two-equivalent couplers. Further, two-equivalent couplers which contain nondiffusive groups as separatable groups and undergo an oxidation coupling reaction to form a diffusive dye can be preferably used. Specific examples of the developing agents and couplers are further described in T. H. James, *The Theory of the Photographic Process,* pp. 291–334 and pp. 354–361, and JP-A-58-123533, 58-149046, 58-149047, 59-111148, 59-124399, 59-174835, 59-231539, 59-231540, 60-2950, 60-2951, 60-14242, 60-23474, and 60-66249.

Other examples of the dye-donating compounds include compounds which serve to imagewise release or diffuse a diffusive dye. This type of a compound can be represented by general formula (LI):

$$(\text{Dye - T})_n\text{—U} \qquad \text{(LI)}$$

wherein Dye represents a dye group or a dye precursor group whose absorption wavelength has been temporarily shifted to a shorter wavelength range; T represents a mere bond or linking group; U represents a group which makes a difference in the diffusivity of compound represented by $(\text{Dye-T})_n$—U in correspondence to or counter correspondence to the light-sensitive silver salt having an imagewise latent image or releases Dye in correspondence to or counter correspondence to the light-sensitive silver salt having an imagewise latent image so that there is no difference in the diffusivity between Dye thus released and $(Dye\text{-}T)_n$—U; and n represents an integer 1 or 2, with the proviso that when n is 2, the two (Dye - T) groups may be the same or different.

Specific examples of dye-donating compounds represented by general formula (Ll) include compounds belonging to the groups 1 to 5 described below. Compounds belonging to groups 1 to 3 form a diffusive dye image (positive dye image) in counter correspondence to the development of the silver halide, and compounds belonging to groups 4 and 5 form a diffusive dye image (nagative dye image) in correspondence to the development of the silver halide.

1. Dye developing agents containing a hydroquinone developing agent and a dye component connected to each other as described in U.S. Pat. Nos. 3,134,764, 3,362,819, 3,597,200, 3,544,545, and 3,482,972. These dye developing agents stay diffusive under alkaline conditions but turn nondiffusive upon reaction with silver halide.

2. As described in U.S. Pat. No. 4,503,137, nondiffusive compounds which release a diffusive dye under alkaline conditions but lose their function upon reaction with silver halide can be used. Examples of such nondiffusive compounds include compounds which undergo an intramolecular nucleophilic substitution reaction to release a diffusive dye as described in U.S. Pat. No. 3,980,479, and compounds which undergo an intramolecular rearrangement reaction of isoxazolone ring to release a diffusive dye as described in U.S. Pat. No. 4,199,354.

3. As described in U.S. Pat. No. 4,559,290, European Patent 220,746A2, and Kokai Giho 87-6199, nondiffusive compounds which undergo a reaction with a reducing agent left unoxidized after development to release a diffusive dye can be used.

Examples of such nondiffusive compounds include compounds which undergo an intramolecular nucleophilic substitution reaction after reduction to release a diffusive dye as disclosed in U.S. Pat. Nos. 4,139,389 and 4,139,379, and JP-A-59-18533 and 57-84453, compounds which undergo an electron migration reaction after reduction to release a diffusive dye as disclosed in U.S. Pat. No. 4,232,107, JP-A-59-101649, and 61-88257, and RD24025 (1984), compounds which undergo a cleavage of single bond after reduction to release a diffusive dye as disclosed in West German Patent 3,008,588A, JP-A-56-142530, and U.S. Pat. Nos. 4,343,893, and 4,619,884, nitro compounds which release a diffusive dye after receiving electrons as disclosed in U.S. Pat. No. 4,450,223, and compounds which release a diffusive dye after receiving electrons as disclosed in U.S. Pat. No. 4,609,610.

Preferred examples of such nondiffusive compounds include compounds containing a N-Z bond (in which Z represents an oxygen atom, sulfur atom or nitrogen atom) and electrophilic group per molecule as disclosed in European Patent 220,746A2, Kokai Giho 87-6199, JP-A-63-201653 and JP-A-63-201654, compounds containing a $SO_2$-Z bond (in which Z is as defined above) and an electrophilic group per molecule as disclosed in JP-A-1-26842, compounds containing a PO-Z bond (in which Z is as defined above) and an electrophilic group as disclosed in JP-A-63-271344, and compounds containing C—Z, bond (in which Z' has the same meaning as Z or represents —$SO_2$—) and an electrophilic group per molecule as disclosed in JP-A-63-271341.

Particularly preferred among these compounds are compounds containing a N-Z bond and an electrophilic group per molecule. Specific examples of such compounds include Compounds (1) to (3), (7) to (10), (12), (13), (15), (23) to (26), (31), (32), (35), (36), (40), (41), (44), (53) to (59), (64), and (70) described in European Patent 220,746A2, and Compounds (11) to (23) described in Kokai Giho 87-6199.

4. Couplers which contain a diffusive dye as separatable group and undergo a reaction with an oxidation product of a reducing agent to release a diffusive dye (DDR coupler). Specific examples of such DDR couplers include those described in British Patent 1,330,524, JP-B-48-39,165, and U.S. Pat. Nos. 3,443,940, 4,474,867, and 4,483,914.

5. Compounds which are reductive to silver halide or organic silver salt but release a diffusive dye after reducing the silver halide or organic silver salt (DDR compound). These compounds require no other reducing agents and thus cause no contamination of image by oxidation-decomposition products of the reducing agents. Typical examples of such DDR compounds are described in U.S. Patents 3,928,312, 4,053,312, 4,055,428, 4,336,322, 3,725,062, 3,728,113, 3,443,939, and 4,500,626, JP-A-59-65839, 59-69839, 53-3819, 51-104343, 58-116537, and 57-179840, and RD17465. Specific examples of DRR compounds include compounds as described in the above cited U.S. Pat. No. 4,500,626, columns 22–44. Particularly preferred among these compounds are Compounds (1) to (3), (10) to (13), (16) to (19), (28) to (30), (33) to (35), (38) to (40), and (42) to (64) described in the above cited U.S. Pat. No. 4,500,626. Further, compounds as described in U.S. Pat. No. 4,639,408, columns 37–39 can be preferably used.

Other examples of the above mentioned couplers and dye-donating compounds other than the compound of general formula (L1) which can be used in the present invention include dye silver compounds containing an organic silver salt and a dye connected to each other as disclosed in Research Disclosure, May 1978, pp. 54 58, azo dyes for use in heat-developable silver dye bleach process as disclosed in U.S. Pat. No. 4,235,957, and Research Disclosure, April 1976, pp. 30 -32, and leuco dyes as disclosed in U.S. Pat. Nos. 3,985,565 and 4,022,617.

In the present invention, the light-sensitive element (heat-developable light-sensitive material) may comprise a compound which can stabilize images while activating development. Specific examples of such a compound which can be preferably used in the present invention are described in U.S. Pat. No. 4,500,626, columns 51–52.

In a heat-developable system in which an image is formed by diffusion transfer of a dye, the light-sensitive element is used in combination with a dye-fixing element. The dye-fixing element may be coated on a support different from the light-sensitive element or on the same support as the light-sensitive element. For the relationship of the light-sensitive element with the dye-fixing element, the support and white reflective layer, those described in U.S. Pat. No. 4,500,626, column 57 can be applied to the present invention.

The dye-fixing element which is preferably used in the present invention comprises at least a layer containing a mordant and a binder. Such a mordant is a mordant known in the art. Specific examples of such a mordant include those described in U.S. Pat. No. 4,500,626, 58th to 59th column, JP-A-61-88256, pp. 32 41, 60-118834, 60-119557, and 60-235134, and Japanese Patent Application Nos. 61-87180 and 61-87181. Further, dye-accepting high molecular compounds as disclosed in U.S. Pat. No. 4,463,079 can be used.

The dye-fixing element may comprise auxiliary layers such as a protective layer, a peel layer and an anticurl layer, as necessary. In particular, the dye-fixing element preferably comprises a protective layer.

The binder for the layers constituting the dye- fixing element is the same natural or synthetic high. molecular substance used as the binder in the light-sensitive element.

One or more of the layers constituting the light-sensitive element and dye-fixing element may contain heat solvents, plasticizers, discoloration inhibitors, UV absorbents, lubricants, matting agents, oxidation inhibitors, dispersed vinyl compounds for increasing dimensional stability, surface active agents, fluorescent brightening agents, etc. Specific examples of these additives are described in JP-A-61-88256, pp. 26–32. In a system in which heat development and dye transfer are simultaneously effected in the presence of a small amount of water, the dye-fixing element may preferably contain a base and/or base precursor as described below to improve the preservability of the light-sensitive element.

In the present invention, the light-sensitive element and/or dye-fixing element may comprise an image formation accelerator. Image formation accelerators serve to accelerate the redox reaction between the silver salt oxidizer and the reducing agent, the production or decomposition of a dye from a dye-donating substance or the release of a diffusive dye from a dye-donating substance, and the migration of a dye from the light-sensitive material layer to the dye-fixing layer. These accelerators can be divided into certain groups, i.e., base or base precursor, nucleophilic compound, high boiling organic solvent (oil), heat solvent, surface active agent and compound which interacts with silver or silver ion, by physicochemical function. However, these substance groups normally exhibit composite functions and thus have some of the above mentioned accelerating effects. These are further described in U.S. Pat. No. 4,678,739, columns 38–40.

Examples of such a base precursor include salts of a base with an organic acid which undergoes decarboxylation by heat, and compounds which undergo intramolecular nucleophilic substitution reaction, Lossen rearrangement or Beckmann rearrangement, to release amines. Specific examples of these salts and compounds are described in U.S. Pat. No. 4,511,493, and JP-A-62-65038. Besides the above mentioned compounds, a combination of a difficultly-soluble metal compound and a compound capable of complexing with metallic ions constituting the difficultly-soluble metal compound (complexing compound) as disclosed in European Patent Disclosure 210,660, and a compound which undergoes electrolysis to produce a base as disclosed in JP-A-61-232451 can be used as the base precursor. In particular, the former compound is effective. The difficultly-soluble metal compound and the complexing compound are separately incorporated into the light-sensitive element and the dye-fixing element to advantage.

The light-sensitive element and/or dye-fixing element of the present invention may comprise various development stopping agents for the purpose of providing invariably constant images against the fluctuation of processing temperature and time.

The term "development stopping agent" as used herein means a compound which readily neutralizes or reacts with a base after a proper development to reduce the base concentration in the film to stop development or which interacts with silver or silver salt after a proper development to inhibit development. Specific examples of such a development inhibitor include acid precursors which release an acid on heating, electrophilic compounds which undergo a substitution reaction with a base present therewith on heating, nitrogen-containing heterocyclic compounds, mercapto compounds, and precursors thereof (e.g., compounds as disclosed in U.S. Pat. Nos. 4,670,373, 4,656,126, 4,610,957, 4,626,499, 4,678,735, and 4,639,408, and JP-A-61-147249, 61-147244, 61-184539, 61-185743, 61-185744, 61-188540, 61-269148, and 61-269143).

The layers constituting the light-sensitive element and/or dye-fixing element of the present invention (e.g., photographic emulsion layer, dye-fixing layer) may contain an inorganic or organic film hardener.

Specific examples of such a film hardener include those described in U.S. Pat. No. 4,678,739, 41st column, and JP-A-59-116655. These film hardeners may be used singly or in combination.

The support to be used for the light-sensitive element and/or dye-fixing element of the present invention can withstand the processing temperature. The general support materials can be glass, paper, polymeric film, metal and analogue thereof as well as the compounds described as supports in JP-A-61-147244, page 25.

The light-sensitive element and/or dye-fixing element of the present invention may be in a form having an electrically-conductive heating element layer as a heating means for heat development or dye diffusion transfer.

In this case, a transparent or opaque heating element can be prepared as a resistive heating element by utilizing any known technich. Such a resistive heating element can be prepared by a method utilizing a thin film of an inorganic semiconducting material or a method utilizing a thin film of an organic compound comprising finely divided electrically-conductive grains dispersed in a binder. The materials which can be used in these methods are those described in JP-A-61-145544. Such an electrically-conductive layer also serves as an antistatic layer.

In the present invention, the coating of a heat-developable light-sensitive layer, a protective layer, an interlayer, a subbing layer, a backing layer, a adye-fixing layer, and other layers can be accomplished by methods as described in U.S. Pat. No. 4,500,626, columns 55–56.

The light sources to which the light-sensitive element is exposed to record images thereon include radiation including visible light. In general, light sources for use in color printing, such as tungsten lamp, laser, CRT, light-emitting diode (LED), and light sources as described in U.S. Pat. No. 4,500,626 (56th column) can be used.

In the heat development process, development can be effected at a heating temperature of about 50° C. to about 250 ° C., particularly about 80° C. to about 180° C. The dye diffusion transfer process may be effected simultaneously with or after the heat development process. In the latter case, heat transfer can be effected at a temperature ranging from room temperature to that used in the heat development process, particularly from 50° C. to a temperature about 10° C. lower than that used in the heat development process.

The migration of a dye can be effected by the action of heat alone but may be accelerated by the use of a solvent.

As further described in JP-A-59-218443 and 61-238056, a method which comprises heating the system in the presence of a small amount of a solvent (particularly water) to effect development and transfer simultaneously or continuously is also useful. In this process, the heating temperature is preferably in the range of 50° C. to the boiling point of the solvent. For example, if the solvent is water, the heating temperature is preferably in the range of 50° C. to 100° C.

Examples of solvents to be used for the acceleration of development and/or migration .of a diffusive dye to the dye-fixing layer include water, and basic aqueous solution containing an inorganic alkaline metal salt or organic base (as such a base there can be used any of those described with reference to the image formation accelerator). Alternatively, a low boiling solvent or a mixture of a low boiling solvent and water or a basic aqueous solution may be used. Further, a surface active agent, a fog inhibitor, a combination of difficultly-soluble metal salt and complexing compound, etc. may be contained in these solvents.

When used, these solvents may be provided to either or both of the dye-fixing element and the light- sensitive element. The amount of the solvent to be used may be as small as not more than the weight of the solvent corresponding to the maximum swelling volume of all the coat films (particularly not more than the weight of the solvent corresponding to the maximum swelling volume of all the coat films minus the weight of all the coat films).

Examples of the process for providing the solvent to the light-sensitive layer or dye-fixing layer include the methods disclosed in JP-A-61-147244, page 26. Alternatively, the solvent may have been previously incorporated into the light-sensitive element or dye-fixing element in microcapsulized form or the like.

In order to accelerate the dye transfer, a process may be used in which a heat solvent which stays solid at ordinary temperature but fuses at an elevated temperature is incorporated into the light-sensitive element or dye-fixing element. Such a heat solvent may be incorporated into either or both the light-sensitive element and the dye-fixing element. The layer in which the heat solvent is incorporated may be an emulsion layer, an interlayer, a protective layer, and a dye-fixing layer. Preferably, the heat solvent may be incoporated into the dye-fixing layer and/or its adjacent layers.

Examples of such a heat solvent include ureas, pyridines, amides, sulfonamides, imides, alcohols, oxims, and other heterocyclic compounds.

In order to accelerate the dye transfer, a high boiling organic solvent may be incorporated into the light-sensitive element and/or dye-fixing element.

If the heat-developable color light-sensitive material of the present invention is used to form a color image, various steps may be combined. For example, if a so-called two-sheet type photographic light-sensitive material comprising a light-sensitive layer and a dye- fixing layer formed on separate supports is used, typical examples of combinations of steps include:

(i) exposure step—heat development step—light-sensitive material-image-receiving material lamination step—transfer step—peeling step;

(ii) exposure step—light-sensitive material—image-receiving material lamination step—heat development/-transfer step peeling step;

(iii) exposure step—heat development step—solvent providing step light-sensitive material-image-receiving material lamination step—transfer step—peeling step;

(iv) exposure step—solvent providing step—light-sensitive material-image-receiving material lamination step—heat development/transfer step—peeling step.

The peeling step can be omitted depending on the constitution of the image-receiving material. The above mentioned classification is given for convenience. Therefore, a plurality of steps may be continuously carried out. For example, the exposure may be followed by heat development. Alternatively, one step may be carried out at a plurality of stages. Further, these steps may not be definitely classified. These step combinations can be properly selected depending on the process for the generation of bases, e.g., if a heatdecomposable base precursor is incorporated into the system or compounds which have been incorporated into two photographic light-sensitive materials in the presence of a solvent are allowed to undergo reaction to generate a base, or the method of using an accelerator for adjusting the rate of development and transfer.

Further, a process may be employed in which a heat-developable light-sensitive material is held in a state so that the reaction between the silver halide and a reducing agent occurs in preference to the reaction for the formation or release of a diffusive dye for a predetermined period of time during or after imagewise exposure before heat development. In this process, the state in which the reaction between silver halide and a reducing agent occurs in preference to the reaction for the formation or release of a diffusive dye is a state that the temperature is kept to not higher than the temperature enabling the reaction for the formation or release of a diffusive dye (heat development temperature) so that the reaction between silver halide and a reducing agent occurs. The state in which the reaction between the silver halide and a reducing agent occurs is a state in which the pH value and temperature of the light-sensitive layer in the heat-developable light-sensitive material fully satisfy the requirements for the reaction between the silver halide and a reducing agent.

The temperature lower than the heat development temperature is preferably the temperature 10° C. or more, more preferably 15° C. or more, lower than the heat development temperature (i.e., temperature predetermined for the reaction for the formation or release of a diffusive dye from a dye-donating compound). The temperature may fluctuate in this range.

In this case, as mentioned above, the photographic light-sensitive material is held in the above defined state for a predetermined period of time required to obtain preferably at least 5%, particularly 10%, of the target amount of the developed silver.

Examples of the heating means to be used at the development and/or the transfer step include those described in JP-A-61-147244, pp. 26–27, such as a hot plate, iron, and heated roller.

In order to laminate the light-sensitive element and the dye-fixing element in close contact, the pressure condition and pressurizing method as described in JP-A-61-147244, page 27, can be applied.

In order to process the photographic element of the present invention, various heat developing apparatuses can be used. For example, the apparatus as described in JP-A-59-75247, 59-177547, 59-181353, and 60-18951, and Utility Model 62-25944 may be preferably used.

The compound of general formula (I) can be used for color diffusion transfer silver halide photographic material which is developed with a processing solution in the vicinity of room temperature. The color diffusion transfer process is further described in Belgian Patent 757,959. The dye-donating substance to be used in the color diffusion transfer process is a compound of general formula (I) wherein PUG is a diffusive dye. Further, a compound represented by general formula (L1) can be used.

The color diffusion transfer photographic element is further described hereinafter.

The color diffusion transfer photographic element is preferably a film unit comprising a combination of a light-sensitive material (light-sensitive element) and a dye-fixing material (dye-receiving element).

In a typical form of the film unit, the above mentioned image-receiving element and light-sensitive element are laminated on a transparent support so that the light-sensitive element does not need to be peeled off the image-receiving element after formation of the transfer image. Specifically, the image-receiving element consists of at least one mordant layer. A preferred form of the light-sensitive element consists of a combination of a blue-sensitive emulsion layer, a green-sensitive emulsion layer and a red-sensitive emulsion layer, a combination of a green-sensitive emulsion layer, a red-sensitive emulsion layer and an infrared-sensitive emulsion layer, or a combination of a blue-sensitive emulsion layer, a red-sensitive emulsion layer and an infrared-sensitive emulsion layer, each emulsion layer being combined with a yellow dye-donating substance, magenta dye-donating substance and cyan dye-donating substance, respectively (the term "infrared-sensitive emulsion layer" as used herein means an emulsion layer having sensitivity to light of a wavelength of 700 nm or more, particularly 740 nm or more). Between the mordant layer and the light-sensitive layer or the dye-donating substance-containing layer may be provided a white reflective layer containing a solid pigment such as titanium oxide so that the transfer image can be viewed through the transparent support. A light-screening layer may be further provided between the white reflective layer and the light-sensitive layer so that development can be completed in a dark place. If necessary, a peel layer may be provided in a proper position so that the light-sensitive element can be entirely or partially peeled off the image-receiving element (such a form is further described in JP-A-56-67840 and Canadian Patent 674,082).

In another peelless form, the above mentioned light-sensitive element is coated on a transparent support, a white reflective layer is coated on the light-sensitive element, and an image-receiving layer is laminated thereon. A form in which an image-receiving element, a white reflective layer and a peel layer are laminated on the same support so that the light-sensitive element can be intentionally peeled off the image-receiving element is described in U.S. Pat. No. 3,730,718. On the other hand, typical forms in which a light-sensitive element and an image-receiving element are separately coated on two supports can be roughly divided into two groups, i.e., peel type and peelless type. Specifically, in a preferred form of peel type film unit, the support has at least one image-receiving layer on one surface thereof and a light-reflecting layer on the other surface thereof. A light-sensitive element is coated on a support having a light-screening layer in such an arragement that the light-sensitive layer side and the mordant layer side are not opposed to each other before exposure but the light-sensitive layer side is reversed to come into contact with the image-receiving layer side after exposure (e.g., during development). Once a transfer image is formed on the mordant layer, the light-sensitive element is readily peeled off the image-receiving element.

In a preferred form of the peelless type film unit, at least one mordant layer is coated on a transparent support and a light-sensitive element is coated on a transparent support or a support having a light-screening layer in such an arrangement that the light-sensitive layer side and the mordant layer side are opposed to each other in close contact.

The above mentioned color diffusion transfer photographic element may be further combined with a pressure-rupturable vessel containing an alkaline processing solution (processing element). In particular, in a peelless type film unit comprising an image-receiving element and a light-sensitive element laminated on a support, this processing element may be preferably interposed between the light-sensitive element and a cover sheet laminated thereon. In a form in which a light-sensitive element and an image-receiving element are separately coated on two supports, the processing element is preferably positioned between the light-sensitive element and the image-receiving element on development at the latest. The processing element preferably comprises a light-screening layer (e.g., carbon black or dye which changes its color by pH) and/or white pigment (titanium oxide). In a color diffusion transfer film unit, a neutralization timing mechanism comprising a combination of a neutralizing layer and a neutralization timing layer may be preferably incorporated into the cover sheet, image-receiving element or light-sensitive element.

The present invention will be further described in the following examples, but the present invention should not be construed as being limited thereto.

EXAMPLE 1

The preparation of Emulsion (I) for the 1st layer is described hereinafter.

To an aqueous solution of gelatin (obtained by dissolving 20 g of gelatin and 3 g of sodium chloride in 1,000 ml of water, kept at a temperature of 75° C.) were simultaneously added 600 ml of an aqueous solution containing sodium chloride and potassium bromide and an aqueous solution of silver nitrate (obtained by dissolving 0.59 mol of silver nitrate in 600 ml of water) at the same flow rate with vigorous stirring in 40 minutes. Thus, a monodisperse emulsion of cubic silver bromochloride grains with an average grain size of 0.35 μm (bromine content: 80 mol %) was prepared.

After rinse and desalting, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion was 600 g.

The preparation of Emulsion (II) for the 3rd layer is described hereinafter.

To an aqueous solution of gelatin (obtained by dissolving 20 g of gelatin and 3 g of sodium chloride in 1,000 ml of water, kept at a temperature of 75° C.) were simultaneously added 600 ml of an aqueous solution containing sodium chloride and potassium bromide, an aqueous solution of silver nitrate (obtained by dissolving 0.59 mol of silver nitrate in 600 ml of water) and a dye solution (I) set forth below at the same flow rate with vigorous stirring in 40 minutes. Thus, a monodisperse emulsion of cubic silver bromochloride grains with an average grain size of 0.35 μm (bromine content: 80 mol %) was prepared.

After rinsing and desalting, the emulsion was then subjected to chemical sensitization with 5 mg of sodium thiosulfate and 20 mg of 4-hydroxy-6-methyl-1,3,3a,7-tetrazaindene at a temperature of 60° C. The yield of the emulsion was 600 g.

Dye Solution (I)

Dye of the chemical structure:

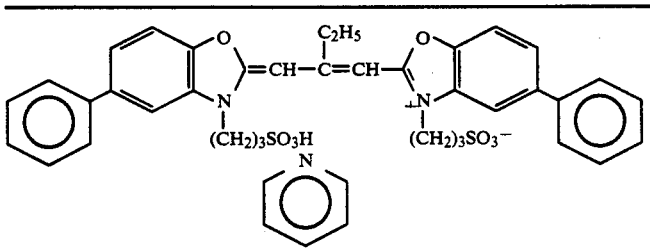

160 mg

Methanol 400 ml

The preparation of Emulsion (III) for the 5th layer is described hereinafter.

To an aqueous solution of gelatin (obtained by dissolving 20 g of gelatin and ammonia in 1,000 ml of water, kept at a temperature of 50° C.) were simultaneously added 1,000 ml of an aqueous solution containing potassium iodide and potassium bromide and an aqueous solution of silver nitrate (obtained by dissolving 1 mol of silver nitrate in 1,000 ml of water) with vigorous stirring while the pAg value of the system was kept constant. Thus, a monodisperse emulsion of octahedral silver bromoiodide grains with an average grain size of 0.5 μm (iodine content: 5 mol %) was prepared.

After rinse and desalting, the emulsion was then subjected to gold and sulfur sensitization with 5 mg of chloroauric acid (tetrahydrate) and 2 mg of sodium thiosulfate at a temperature of 60° C. The yield of the emulsion was 1 kg.

The preparation of a gelatin dispersion of a dye-donating substance will be described hereinafter.

22 g of a yellow dye-donating substance 7 (Exemplary compound 7 of general formula (I)), 20 g of an electron donor (ED-11) and 9 g of tricyclohexyl phosphate were measured out. To these materials was added 46 ml of cyclohexanone. The mixture was then heated to a temperature of about 60° C. for dissolution to prepare a uniform solution. The solution was then mixed with 100 g of a 10% aqueous solution of a lime-treated gelatin, 60 ml of water and 1.5 g of sodium dodecylbenzenesulfonate with stirring. The system was then subjected to dispersion at 10,000 rpm by a homogenizer for 10 minutes. This dispersion was used as a dispersion of a yellow dye-donating substance.

Dispersions of magenta and cyan-donating substances were prepared from a magenta dye-donating substance 6 and a cyan dye-donating substance 8, respectively, (which correspond to the compounds of general formula (I), Exemplary compounds 6 and 8, respectively) in the same manner as in the dispersion of a yellow dye-donating substance.

These emulsions and dye-donating substance dispersions were used to prepare a Multi-Layer Color Photographic Light-Sensitive Material 101 as set forth in Table 3.

TABLE 3

| Layer No. | Layer name | Additives | Added amount (g/m²) |
|---|---|---|---|
| 6th layer | Protective layer | Gelatin | 0.91 |
| | | Matting agent (silica) | 0.03 |
| | | Water-soluble polymer (1)* | 0.23 |
| | | Surface active agent (1)* | 0.06 |
| | | Surface active agent (2)* | 0.13 |
| | | Film hardener (1)* | 0.01 |
| | | $ZnSO_4.7H_2O$ | 0.06 |
| 5th layer | Blue-sensitive Layer | Emulsion (III) | 0.58 (as calculated in terms of silver) |
| | | Gelatin | 0.68 |
| | | Fog inhibitor (1)* | $0.36 \times 10^{-3}$ |
| | | Yellow dye-donating substance (7) | 0.61 |
| | | High boiling organic solvent (1)* | 0.25 |
| | | Electron donor (ED-11) | 0.55 |
| | | Surface active agent (3)* | 0.04 |
| | | Electron transfer agent (ETA-2) | 0.04 |
| | | Film hardener (1)* | 0.01 |
| | | Water-soluble polymer (3)* | 0.03 |
| | | Water-soluble polymer (2)* | 0.02 |
| 4th layer | Interlayer | Gelatin | 0.75 |
| | | $Zn(OH)_2$ | 0.32 |
| | | Surface active agent (1)* | 0.02 |
| | | Surface active agent (4)* | 0.07 |
| | | Water-soluble polymer (2)* | 0.02 |
| | | Film hardener (1)* | 0.01 |
| | | Reducing agent (1)* | 0.27 |
| 3rd layer | Green-sensitive layer | Emulsion (II) | 0.41 (as calculated in terms of silver) |
| | | Gelatin | 0.47 |
| | | Fog inhibitor (1) | $1.25 \times 10^{-3}$ |
| | | Magenta dye-donating substance (6) | 0.50 |
| | | High boiling organic solvent (1)* | 0.19 |
| | | Electron donor (ED-11) | 0.38 |
| | | Surface active agent (3)* | 0.04 |
| | | Electron transfer agent (ETA-2) | 0.04 |
| | | Film hardener (1)* | 0.01 |
| | | Water-soluble polymer (3)* | 0.03 |
| | | Water-soluble | 0.02 |

TABLE 3-continued

| | | | |
|---|---|---|---|
| | | polymer (2)* | |
| 2nd layer | Interlayer | Gelatin | 0.80 |
| | | $Zn(OH)_2$ | 0.31 |
| | | Surface active agent (1)* | 0.06 |
| | | Surface active agent (4)* | 0.10 |
| | | Water-soluble polymer (2)* | 0.03 |
| | | Film hardener (1)* | 0.01 |
| | | Reducing agent (1)* | 0.27 |
| 1st layer | Red-sensitive layer | Emulsion (I) | 0.36 (as calculated in terms of silver) |
| | | Sensitizing dye (1)* | $1.07 \times 10^{-3}$ |
| | | Gelatin | 0.49 |
| | | Fog inhibitor (1)* | $1.25 \times 10^{-3}$ |
| | | Cyan dye-donating substance (8) | 0.40 |
| | | High boiling organic solvent (1) | 0.20 |
| | | Electron donor (ED-11) | 0.20 |
| | | Surface active agent (3)* | 0.04 |
| | | Electron transfer agent (ETA-2) | 0.04 |
| | | Film hardener (1)* | 0.01 |
| | | Water-soluble polymer (2)* | 0.02 |
| | | Water-soluble polymer (3)* | 0.03 |
| Support (polyethylene terephthalate; thickness: 100 μm) | | | |
| Backing layer | | Carbon black | 0.44 |
| | | Polyester | 0.30 |
| | | Polyvinyl chloride | 0.30 |

Water-soluble polymer (1)*:
Sumicagel L-5 (H), available from Sumitomo Chemical Co., Ltd.
Water-soluble polymer (2)*:

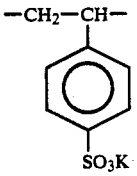

Water-soluble polymer (3)*:

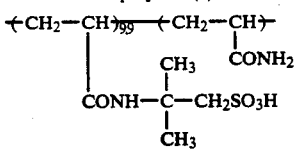

Surface active agent (1)*:
Aerosol OT
Surface active agent (2)*:

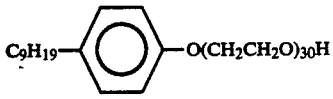

Surface active agent (3)*:

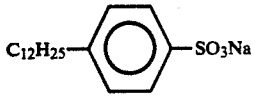

Surface active agent (4)*:

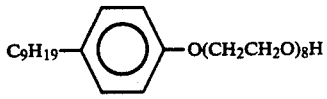

Film hardener (1)*: 1,2-Bis(vinylsulfonylacetamide)ethane
Reducing agent (1)*:

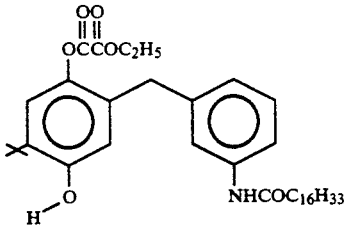

High boiling organic solvent (1)*: Tricyclohexylphosphate
Fog inhibitor (1)*:

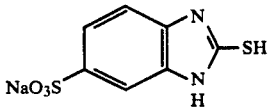

Sensitizing dye (1)*:

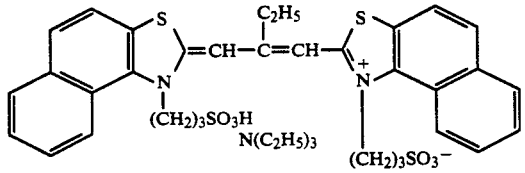

The preparation of a dye-fixing material will be described hereinafter.

63 g of gelatin, 130 g of a mordant having the chemical structure set forth below, and 80 g of guanidine picolate were dissolved in 1,300 ml of water. The solution was coated on a polyethylene-laminated paper support to a wet thickness of 45 μm, and then dried.

Mordant

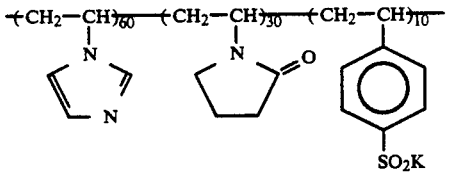

Onto the coat film was coated a solution obtained by dissolving 35 g of gelatin and 1.05 g of 1,2-bis(vinylsulfonylacetamide)ethane as film hardener in 800 ml of of water to a wet thickness of 17 μm. The material was then dried to prepare a dye-fixing material.

The Multi-Layer Color Light-Sensitive Material 101 thus prepared was exposed to light of 2,000 lux from a tungsten lamp through B, G, R and grey color separation filters having a continuous density gradation for 1 second.

Into the emulsion surface of the color light-sensitive material thus exposed was supplied water at a rate of 15 $ml/m^2$ by means of a wire bar. The color light-sensitive material was then laminated on the dye-fixing material in such a manner that the film surfaces thereof came into contact with each other.

The lamination was heated for 20 seconds by a heat roller whose temperature had been adjusted to keep the temperature of the film which had absorbed water to 75° C. When the dye-fixing material was peeled off the light-sensitive material, sharp blue, green, red and grey images were observed formed on the dye-fixing material in correspondence to the B, G, R and grey color separation filters, respectively. These images were measured for maximum density (Dmax) and minimum density (Dmin). The results are set forth in Table 4.

TABLE 4

| Light-sensitive element | | Maximum density | Minimum density |
|---|---|---|---|
| 101 | B | 1.59 | 0.24 |
| | G | 1.70 | 0.25 |
| | R | 1.88 | 0.27 |

Table 4 shows that the present invention provides a positive image with a high maximum density and a low minimum density.

EXAMPLE 2

Onto a 180-μm thick gelatin-undercoated polyethylene terephthalate support, of which one surface was undercoated with gelatin, were coated the following layers:

(1) a layer containing 2.0 g/m$^2$ of gelatin and 1,3-vinylsulfonyl-2-propanol; and (2) a layer containing 1.0 g/m$^2$ of gelatin, 0.12 mmol/m$^2$ of a compound set forth in Table 5, 0.17 mmol/m$^2$ of a betaine type surface active agent of the chemical structure set forth below, and 1,3-vinylsulfonyl-2-propanol.

$$C_{11}H_{23}CONH(CH_2)_3\overset{\overset{CH_3}{|}}{\underset{\underset{CH_3}{|}}{N}}{}^{+}(CH_2)_4SO_3^{-}$$

The compounds set forth in Table 5 were added to the system in the form of a solution in a small amount of dimethylformamide with stirring before the film hardener for the coating solution for the 2nd layer was added to the system.

These coat specimens were then measured for spectral absorption spectrum by means of a spectrophotometer U-3210 available from Hitachi Limited. The results of maximum absorption wavelength and absorbance and half-value width at maximum absorption wavelength are set forth in Table 5.

A comparative specimen was prepared in the same manner as described above except that a layer containing a dispersion of a dye A set forth below prepared in accordance with the method described in the example in International Patent Application Disclosure (WO) 88/04794, 1.0 g/m$^2$ of gelatin, 0.12 mmol/m$^2$ of a dye and 1,3- vinylsulfonyl-2-propanol was provided instead of the 2nd layer.

Dye A

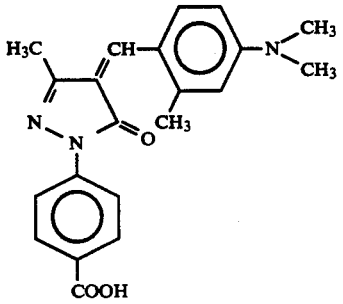

Another comparative specimen was prepared in the same manner as in the present specimens except that a layer containing 1.0 g/m$^2$ of gelatin, 0.12 mmol/m$^2$ of Dye B of the chemical structure set forth below, and 1,3-vinylsulfonyl-2-propanol was provided instead of the 2nd layer.

The dye was added in the form of aqueous solution.

Dye B

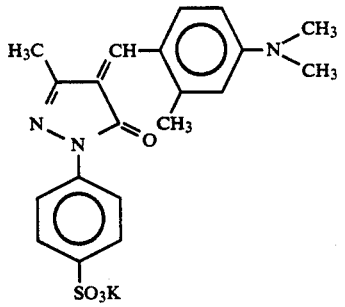

TABLE 5

| Coat Specimen No. | Compound No. | Maximum absoption wavelength (nm) | Absorbance | Half-value width (nm) | Percentage fixing (%) |
|---|---|---|---|---|---|
| 1 (Comparison) | A | 504 | 0.160 | 210 | 99 |
| 2 (Comparison) | B | 492 | 0.620 | 75 | 0 |
| 3 (Invention) | 13 | 481 | 0.335 | 118 | 95 |
| 4 (Invention) | 9 | 485 | 0.350 | 120 | 96 |

Table 5 shows that the compound of general formula (I) generally exhibits a small half-value width, a sharp absorption characteristic and a high absorbance compared to dispersible solid dyes. This makes it clear that the dyes of general formula (I) exhibit excellent properties as filter dyes as well as antihalation dyes for light-sensitive materials which are exposed to light of a specified wavelength.

EXAMPLE 3

The specimens prepared in Example 2 were dipped in a phosphoric buffer with a pH value of 5 for 5 minutes, lightly washed with water, dried, and then measured for absorbance. The percentage fixing was obtained by dividing this value by the value obtained before dipping. The results are set forth in Table 5.

Table 5 shows that the dyes of the present invention can be substantially sufficiently fixed, particularly in a specific layer as compared to the water-soluble Dye B.

EXAMPLE 4

A comparative specimen was prepared as Coat Specimen No. 5 in the same manner as in Example 2 except that Dye C of the chemical structure set forth below was used instead of the dye to be incorporated in the 2nd layer.

Dye C

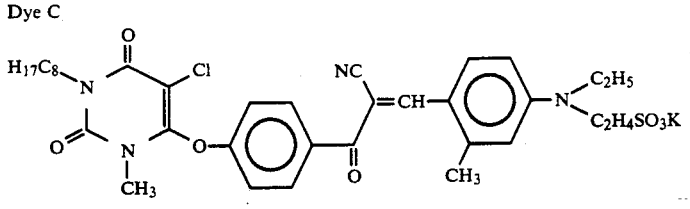

The comparative specimen and Specimen Nos. 3 and 4 as prepared in Example 2 were developed by an automatic developing machine FG-310PTS available from Fuji Photo Film Co., Ltd. at a temperature of 38° C. for 20 seconds for decoloration test. The developer and fixing solution were LD-835 and LF-308 available from Fuji Photo Film Co., Ltd., respectively.

The results are set forth in Table 6.

TABLE 6

| Coat Specimen No. | % Residual color |
|---|---|
| 5 (Comparison) | 15 |
| 3 (Invention) | Substantially zero |
| 4 (Invention) | Substantially zero |

Table 6 shows that the compounds of general formula (I) exhibit a small residual color (color remainder).

EXAMPLE 5

Preparation of Emulsion A

An aqueous of silver nitrate and an aqueous solution of sodium chloride containing $0.5\times10^{-4}$ mol of ammonium hexachlorinated rhodiumate (III) were mixed in a gelatin solution at a temperature of 35° C. by a double jet process while the pH value of the system was controlled to 6.5 to prepare a monodisperse emulsion of silver chloride grains with an average grain size of 0.07 μm.

After the formation of grains, the emulsion was then subjected to flocculation well known in the art to remove soluble salts therefrom. To the emulsion were added 4-hydroxy-6-methyl-1,3,3a,7-tetrazaindene and 1-phenyl-5- mercaptotetrazole as stabilizers. The emulsion contained 55 g of gelatin and 105 g of silver per kg (Emulsion A).

Preparation of Light-Sensitive Material

To Emulsion A were added nucleating agents, nucleation accelerators and dye for enhancing safety to safelight as set forth in Table 7.

TABLE 7

(Added amount: mg/m²)

(Nucleating agent)

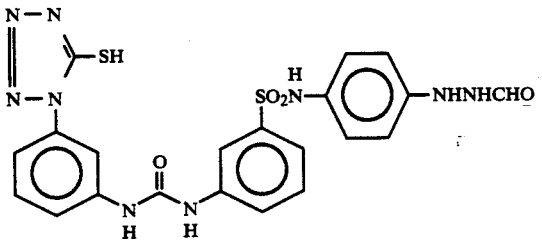

11.8

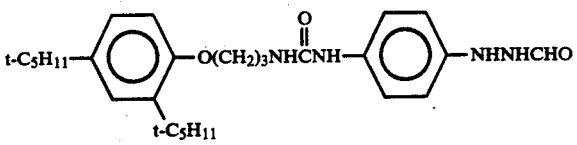

9.3

(Nucleation accelerator)

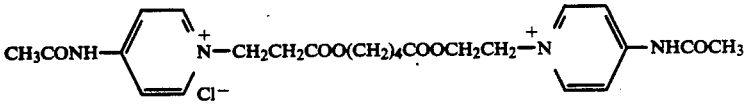

28.0

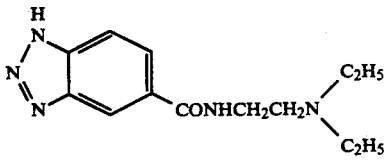

60.0

(Safelight dye)

TABLE 7-continued

| | (Added amount: mg/m²) |
|---|---|
| 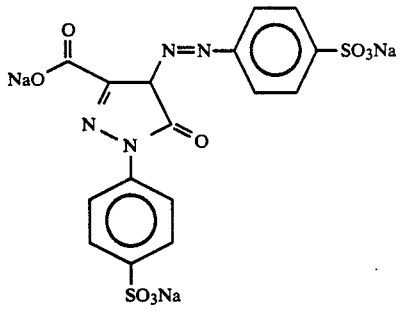 | 50.0 |

To the emulsion were added 14 mg/m² of a polyethyl acrylate latex and a sodium salt of 2,4-dichloro-6-hydroxy-1,3,5-triazine as film hardener. The emulsion was then coated on a transparent polyethylene terephthalate support as a silver halide emulsion layer in an amount of 3.5 g per m² as calculated in terms of silver. Onto the silver halide emulsion layer were coated gelatin (1.3 g/m²), Compound 9 of general formula (I) (0.1 g/m²), three surface active agents as set forth in Table 8, a stabilizer, and a protective layer containing a matting agent as coating aids. The material was then dried. (Coat Specimen No. 5-1)

TABLE 8

| Coating aid | (Added amount: mg/m²) |
|---|---|
| (Surface active agent) | |
| 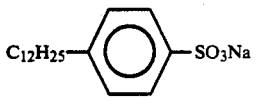 | 35 |
| $CH_2COOC_6H_{13}$ \| $CHCOOC_6H_{13}$ \| $SO_3Na$ | 30 |
| $C_8F_{17}SO_2N(C_3H_7)CH_2COOK$ | 2.5 |
| (Stabilizer) | |
| Thioctic acid | 6.0 |
| (Matting agent) | |
| Polymethyl methacrylate (average grain diameter: 2.5 μm) | 9.0 |

The compound of general formula (I) was dispersed in gelatin in the form of a solution in a minimum amount of dimethylformamide as in Example 2.

Coat Specimen 5-2 was prepared in the same manner as in Coat Specimen 5-1 except that Compound 13 was used instead of Compound 9.

Preparation of Comparative Specimens

1) Comparative Coat Specimen 5-3 was prepared in the same manner as in Coat Specimen 5-1 except that Compound 9 was omitted.

2) Comparative Coat Specimen 5-4 was prepared in the same manner as in Coat Specimen 5-1 except that a water-soluble ultraviolet-absorbing Dye D was used in an amount of 0.05 g/m² instead of Compound 9.

Dye D

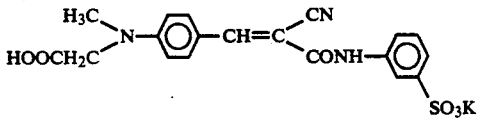

Evaluation of Properties (1) The above mentioned three specimens were each exposed to light through an optical wedge in a daylight printer P-607 available from Dainippon Screen Mfg. Co., Ltd., developed with a developer set forth below at a temperature of 38° C. for 20 seconds, fixed by a commonly used method, rinsed, and then dried. The highlighted portion of Specimens 5-1, 5-2 and 5-4 exhibited as low UV optical density as Specimen 5-3. Thus, these specimens were completely decolored.

| Basic formulation of developer | |
|---|---|
| Hydroquinone | 35.0 g |
| N-methyl-p-aminophenol (½ sulfate) | 0.8 g |
| Sodium hydroxide | 13.0 g |
| Tribasic potassium phosphate | 74.0 g |
| Potassium sulfite | 90.0 g |
| Tetrasodium ethylenediaminetetraacetate | 1.0 g |
| Potassium bromide | 4.0 g |
| 5-Methylbenzotriazole | 0.6 g |
| 3-Diethylamino-1,2-propanediol | 15.0 g |
| Water to make | 1 l |
| pH | 11.5 |

Comparative Specimen 5-4, and Present Specimens 5-1 and 5-2 can reduce sensitivity by 0.4 and 0.45, respectively, from that of Comparative Specimen 5-3 as calculated in terms of log E. Practically, Specimens 5-1, 5-2 and 5-4 exhibited a proper range of sensitivity.

(2) Test for safety to safelight

The above mentioned three specimens were examined for safe time under a UV cut fluorescent light of 400 lux (FLR-40SW-DLX-NU/M available from Toshiba) as a safelight. Comparative Specimen 5-4 exhibited safety for 10 minutes. By contrast, Comparative Specimen 5-3 exhibited safety for 18 minutes, and Present Specimens 5-1 and 5-2 exhibited safety for 28 minutes.

(3) Test for tone variability

The above mentioned three specimens were each exposed to light through a plain net screen in the above mentioned printer, and then developed in the same manner as the test (1). These specimens were each measured for exposure time enabling 1:1 reversal of dot area. These specimens were each exposed to light for 2 times and 4 times the exposure time thus obtained to determine the degree of expansion of dot area. The more the expansion is, the better is the tone variability. The results are set forth in Table 9. Table 9 shows that Comparative Specimen 5-4 exhibited a remarkable drop in the tone variability while Present Specimens 5-1 and 5-2 exhibited a high tone variability. This is because that the dye incorporated in Comparative Specimen 5-4is water-soluble and dispersible and thus diffuses uniformly from the later in which it has been incorporated to the light-sensitive emulsion layer, exhibiting an anti-irradiation effect that inhibits the expansion of dot area even when the exposure time is increased. On the other hand, Compounds 9 and 13 of general formula (I) are fixed in the later in which they have been incorporated and thus provide a high tone variability.

TABLE 9

| Tone variability (represented by increase in dot area) | | |
|---|---|---|
| | Two-fold exposure | Four-fold exposure |
| Comparative Specimen 5-3 | +5% | +9% |
| Comparative Specimen 5-4 | +2% | +4% |
| Present Specimen 5-1 | +5% | +9% |
| Present Specimen 5-2 | +5% | +9% |

The silver halide photographic material of the present invention comprises a compound represented by the general formula (I) as a photographically useful reagent-releasing agent and thus can undergo action by a reducing agent commonly used for silver halide photographic materials to immediately release a photographically useful reagent, attaining various photographic effects.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having thereon at least one layer containing a compound represented by general formula (I):

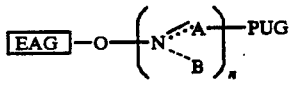

(I)

wherein EAG represents an electron-accepting group; A represents a group which undergoes a reaction triggered by the cleavage of the oxygen-nitrogen single bond in the general formula to release PUG; B represents a hydrogen atom or an alkyl group, an aralkyl group, an aryl group, a heterocylic group, an acyl group, a sulfonyl group, a carbamoyl group, a sulfamoyl group, an alkoxycarbonyl group, an aryloxycarbonyl group, an alkoxysulfonyl group or an aryloxysulfonyl group which may contain substituents; the solid lines indicate a single bond; the broken lines indicate that either of these lines is a bond, with the proviso that when the broken line between N and A represents a bond, B is not present; EAG and B, and A and B may be connected to each other to form a ring; EAG may be connected to a polymer residue to fix the compound of general formula (I) to a high molecular chain; n represents an integer 0 or 1; and PUG represents a photographically useful group, with the proviso that when n is 0, PUG represents a photographically useful group represented by general formula (II):

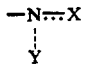

(II)

wherein X and Y each represents an atom or atomic group required to render the group represented by general formula (II) photographically useful; the solid lines indicate a single bond; and the broken lines indicate that either of these lines is a bond, with the proviso that X and Y may be connected to each other to form a heterocyclic group containing N and when the broken line between N and X represents a bond, Y is not present.

2. A silver halide photographic material as claimed in claim 1, wherein said compound represented by general formula (I) is one represented by general formula (III):

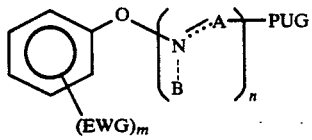

(III)

wherein EWG represents an electron-withdrawing group; m represents an integer from 1 to 5, and if m is 2 or more, the plurality of EWG groups may be the same of different; the phenyl group may contain from 0 to (5−m) substituents or be condensed with other aromatic rings, heterocyclic groups and nonaromatic rings and may be connected to B to form a ring or may be connected to a polymer residue to fix the compound of general formula (III) to a high molecular chain; A and B may be connected to each other to form a ring; and A, B, PUG, and n, the solid line, and the broken lines are as defined in claim 1, with the proviso that at least one of the plurality of the EWG groups is connected to the 2- or 4-position in the ring with respect to the oxygen atom.

3. A silver halide photographic material as claimed in claim 1, wherein said compound represented by general formula (I) is one represented by general formula (IV) or (V):

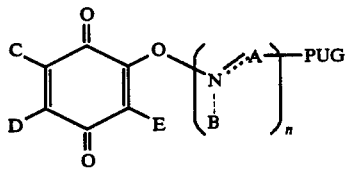

(IV)

-continued (V)

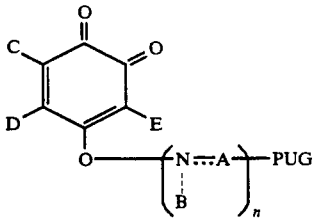

wherein C, D, and E each represents a hydrogen atom, a halogen atom, a cyano group, a nitro group, an alkyl group, an aralkyl group, an aryl group, an alkenyl group, an alkynyl group, an acyl group, a sulfonyl group, a heterocyclic group, an amino group, an alkoxy group, an aryloxy grop, an alkylthio group, an arylthio group, an acyloxy group, a sulfonyloxy group, an acylamino group or a sulfonylamino group which may be substituted or a polymer residue thereof or a group represented by general formula (VI) and may be the same or different and may be connected to each other to form a ring:

(VI)

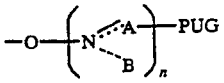

; A and B, and B and E may be connected to each a ring; and PUG, A, B, n, the solid line, and the broken line are as defined in claim 1.

4. A silver halide photographic material as claimed in claim 1, wherein the material contains two compounds according to general formula (I) which have different PUGs.

5. A silver halide photographic material as claimed in claim 1, wherein the material contains two different compounds according to general formula (I), one compound in which PUG is a diffusive dye and one compound in which PUG is a development inhibitor.

6. A silver halide photographic material as claimed in claim 1, wherein the material also comprises a nondiffusive reducing agent and an electron transfer agent.

7. A silver halide photographic material as claimed in claim 1, wherein the film pH of the material is 4 to 7.

8. A silver halide photographic material as claimed in claim 1, wherein the material is a heat developable light-sensitive material.

9. A silver halide photographic material as claimed in claim 1, wherein PUG is a diffusive dye.

10. A silver halide photographic material as claimed in claim 1, wherein PUG is a development inhibitor.

11. A silver halide photographic material as claimed in claim 1, wherein PUG is a filter dye.

12. A diffusion transfer silver halide photographic material, comprising a compound represented by general formula (I):

(I)

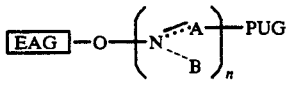

wherein EAG represents an electron-accepting group; A represents a group which undergoes a reaction triggered by the cleavage of the oxygen-nitrogen single bond in the general formula to release PUG; B represents a hydrogen atom or an alkyl group, an aralkyl group, an aryl group, a heterocylic group, an acyl group, a sulfonyl group, a carbamoyl group, a sulfamoyl group, an alkoxycarbonyl group, an aryloxycarbonyl group, an alkoxysulfonyl group or an aryloxysulfonyl group which may contain substituents; the solid lines indicate a single bond; the broken lines indicate that either of these lines is a bond, with the proviso that when the broken line between N and A represents a bond, B is not present; EAG and B, and A and B may be connected to each other to form a ring; EAG may be connected to a polymer residue to fix the compound of general formula (I) to a high molecular chain; n represents an integer 0 or 1; and PUG represents a photographically useful group, with the proviso that when n is 0, PUG represents a photographically useful group represented by general formula (II):

(II)

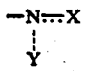

wherein X and Y each represents an atom or atomic group required to render the group represented by general formula (II) photographically useful; the solid lines indicate a single bond; and the broken lines indicate that either of these lines is a bond, with the proviso that X and Y may be connected to each other to form a heterocyclic group containing N and when the broken line between N and X represents a bond, Y is not present.

* * * * *